US010952498B2

(12) United States Patent
Bruce et al.

(10) Patent No.: US 10,952,498 B2
(45) Date of Patent: Mar. 23, 2021

(54) PLATE WITH FOAM FOR FOOTWEAR

(71) Applicant: NIKE, Inc., Beaverton, OR (US)

(72) Inventors: Robert M. Bruce, Portland, OR (US); Bryan P. Conrad, Lake Oswego, OR (US); Nick S. Frank, Portland, OR (US); Troy C. Lindner, Portland, OR (US); Rachel M. Savage, Beaverton, OR (US); James Y. Yoo, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 105 days.

(21) Appl. No.: 15/808,422

(22) Filed: Nov. 9, 2017

(65) Prior Publication Data

US 2018/0132564 A1 May 17, 2018

Related U.S. Application Data

(60) Provisional application No. 62/420,972, filed on Nov. 11, 2016.

(51) Int. Cl.
*A43B 3/00* (2006.01)
*A43B 13/12* (2006.01)
(Continued)

(52) U.S. Cl.
CPC ..... *A43B 13/186* (2013.01); *A43B 3/0068* (2013.01); *A43B 13/04* (2013.01);
(Continued)

(58) Field of Classification Search
CPC ... A43B 3/0068; A43B 13/122; A43B 13/125; A43B 13/127; A43B 13/183
(Continued)

(56) References Cited

U.S. PATENT DOCUMENTS 5,052,130 A * 10/1991 Barry ..... A43B 5/049 36/107
6,009,637 A 1/2000 Pavone
(Continued)

FOREIGN PATENT DOCUMENTS

EP 1857004 A1 * 11/2007 ..... A43B 13/125
EP 3081110 A2 10/2016
WO WO-2016092353 A1 6/2016

OTHER PUBLICATIONS

European Patent Office, International Search Report and Written Opinion for PCT Application No. PCT/US2017/060980 dated Mar. 6, 2018.

*Primary Examiner* — Sharon M Prange
(74) *Attorney, Agent, or Firm* — Honigman LLP; Matthew H. Szalach; Johnathan P. O'Brien

(57) ABSTRACT

A sole structure for an article of footwear having an upper includes an outsole defining a first aperture, a cushioning member disposed on the outsole and defining a second aperture, and a plate disposed between the cushioning member and the upper. The plate includes an anterior-most point disposed in a forefoot region, a posterior-most point disposed closer to a heel region than the anterior-most point, a metatarsophalangeal (MTP) point disposed between the anterior-most point and the posterior-most point, and an anterior curved region having a radius of curvature extending through the forefoot region and a mid-foot region and including a forefoot curved portion extending from the MTP point to the anterior-most point and a mid-foot curved portion extending from the MTP point toward the posterior-most point. Overlapping portions of the first aperture and the second aperture expose a region of the plate.

23 Claims, 20 Drawing Sheets

(51) Int. Cl.

| | |
|---|---|
| ***A43B 13/18*** | (2006.01) |
| ***A43B 13/04*** | (2006.01) |
| ***A43B 13/14*** | (2006.01) |
| ***A43B 13/20*** | (2006.01) |

(52) U.S. Cl.
CPC ..... *A43B 13/122* (2013.01); *A43B 13/125* (2013.01); *A43B 13/127* (2013.01); *A43B 13/141* (2013.01); *A43B 13/181* (2013.01); *A43B 13/184* (2013.01); *A43B 13/188* (2013.01); *A43B 13/189* (2013.01); *A43B 13/20* (2013.01)

(58) Field of Classification Search
USPC ..... 36/107, 108
See application file for complete search history.

(56) References Cited

U.S. PATENT DOCUMENTS 6,050,001 A * 4/2000 Ditrtrich ..... A43B 7/144 36/108
6,205,683 B1 3/2001 Clark et al.
7,096,605 B1 * 8/2006 Kozo ..... A43B 7/08 36/103
7,437,838 B2 * 10/2008 Nau ..... A43B 3/0036 36/102
7,814,686 B2 * 10/2010 Becker ..... A43B 13/026 36/102
8,510,970 B2 * 8/2013 Baum ..... A43B 13/183 36/27
2006/0042120 A1 3/2006 Sokolowski et al.
2013/0247425 A1 * 9/2013 Davis ..... A43B 13/14 36/30 R
2014/0026443 A1 * 1/2014 Derrier ..... A43B 13/14 36/107
2014/0223780 A1 8/2014 Peyton
2014/0259768 A1 * 9/2014 Spiller ..... A43B 7/32 36/87
2016/0037858 A1 2/2016 Foxen
2017/0071286 A1 * 3/2017 Kilgore ..... A43C 15/02
2017/0095033 A1 * 4/2017 Farina ..... A43B 13/188

* cited by examiner

PLATE WITH FOAM FOR FOOTWEAR

CROSS-REFERENCE TO RELATED APPLICATIONS

This application claims priority to U.S. Provisional Application Ser. No. 62/420,972, filed Nov. 11, 2016, which is hereby incorporated by reference in its entirety.

TECHNICAL FIELD

The present disclosure relates to articles of footwear including sole structures with footwear plates and foam for enhancing propulsion of the footwear during running and jumping movements

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

The metatarsophalangeal (MTP) joint of the foot is known to absorb energy as it flexes through dorsiflexion during running and jumping movements. As the foot does not move through plantarflexion until the foot is pushing off of a ground surface, the MTP joint returns little of the energy it absorbs to propel the foot forward, thus, is known to be the source of an energy drain during athletic movements, such as running and jumping movements. Embedding flat and rigid plates having longitudinal stiffness within a sole structure is known to increase the overall stiffness thereof. The use of flat plates can increase a mechanical demand on ankle plantarflexors of the foot, thereby increasing a resultant impulse as the foot pushes off of the ground surface. Generating a greater horizontal impulse as the foot pushes off of the ground can increase the distance traveled during a horizontal jump. It is also known to embed curved and rigid plates within the sole structure to increase the overall stiffness thereof and alleviate the mechanical demand on the ankle plantarflexors of the foot. While curved plates may be particularly well-suited for improving the efficiency of the foot during running movements, intensifying the curvature of curved plates about the MTP joint of the foot may shorten the horizontal jumping distance when the foot propels forward during athletic movements.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
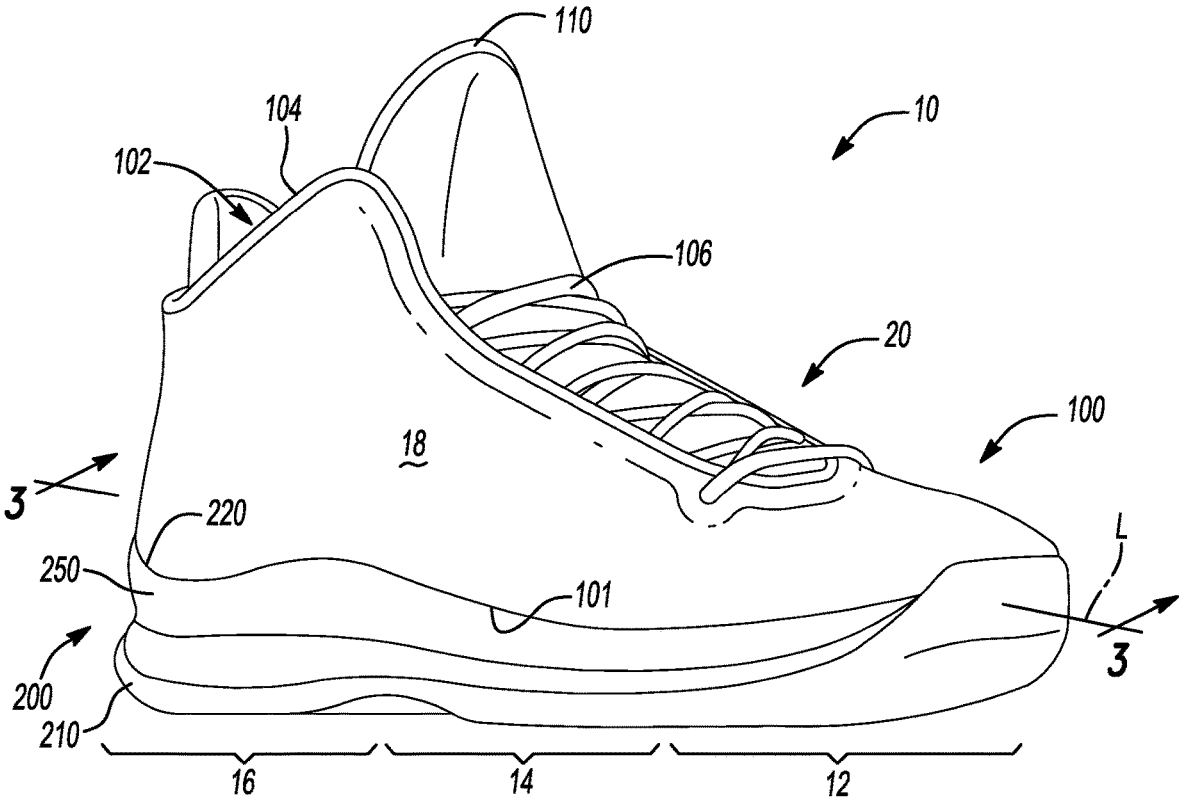
FIG. 1 is a top perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper. The sole structure includes an outsole defining a first aperture, a cushioning member disposed on the outsole and defining a second aperture, and a plate disposed between the cushioning member and the upper. The plate includes an anterior-most point disposed in a forefoot region of the sole structure and a posterior-most point disposed closer to a heel region of the sole structure than the anterior-most point. The plate also includes a metatarsophalangeal (MTP) point disposed between the anterior-most point and the posterior-most point and an anterior curved region having a radius of curvature extending through the forefoot region and a mid-foot region of the sole structure and including a forefoot curved portion extending from the MTP point to the anterior-most point and a mid-foot curved portion extending from the MTP point toward the posterior-most point. The MTP point is opposing an MTP joint of a foot during use. Overlapping portions of the first aperture and the second aperture expose a region of the plate.

Implementations of the disclosure may include one or more of the following optional features. In some implementations, the anterior-most point and the posterior-most point are co-planar. The plate may include a posterior curved region disposed within the heel region of the sole structure, the posterior-most point being located within the posterior curved region. The mid-foot curved portion may extend from the MTP point to an aft point disposed within the mid-foot region of the sole structure between the MTP point and the posterior-most point. The aft point and the anterior-most point may be co-planar. A planar extent to posterior-most point may be offset relative to the planar extent of the aft point and the anterior-most point. The sole structure may also include a blend portion disposed between and connecting the anterior curved region and the posterior curved region. The blend portion may include a substantially constant curvature.

In some examples, the second aperture defined by the cushioning member includes an apex point disposed within the mid-foot region of the sole structure. The second aperture may include a lateral segment extending toward the forefoot region along a lateral side of the sole structure from the apex point and a medial segment extending toward the forefoot region along a medial side of the sole structure from the apex point. The lateral segment and the medial segment of the second aperture defined by the cushioning member may define a peninsular region within the forefoot region of the sole structure.

In some examples, the first aperture defined by the outsole may include an apex point disposed within the mid-foot region of the sole structure, a lateral segment extending toward the forefoot region along the lateral side of the sole structure from the apex point, and a medial segment extending toward the forefoot region along the medial side of the sole structure from the apex point. The apex point of the first aperture defined by the outsole may be disposed closer to the heel region of the sole structure than the apex point of the second aperture defined by the cushioning member. Portions of the first aperture defined by the outsole that do not overlap with the second aperture defined by the cushioning member may be operative to expose the cushioning member.

In some implementations, the sole structure includes a fluid-filled bladder disposed between the plate and the outsole. The fluid-filled bladder may be disposed within a cut-out region formed through the cushioning member. The portion of the cut-out region unoccupied by the fluid-filled bladder may define the second aperture. The MTP point may be located approximately thirty percent (30%) of the total length of the plate from the anterior-most point. The center of the radius of curvature of the anterior curved region may be located at the MTP point.

In some examples, the sole structure includes a strobel attached to the upper to define an interior void. The plate may be disposed on the strobel within the interior void. The plate may be visible through an ankle opening defined by the upper in the heel region. The ankle opening may be configured to provide access to the interior void. The sole structure may also include a midsole received by the interior void of the upper and opposing the plate. The strobel may define a third aperture that overlaps with the overlapping portions of the first aperture and the second aperture to expose the plate. The exposed region of the plate may include the anterior curved region.

Another aspect of the disclosure provides a method of manufacturing an article of footwear. The method includes attaching a strobel to an upper, the upper defining an interior void and an ankle opening providing access to the interior void, providing an outsole defining a first aperture, attaching a cushioning member to the outsole, the cushioning member defining a second aperture, and positioning a plate between the cushioning member and the upper. The plate includes an anterior-most point disposed in a forefoot region of the footwear and a posterior-most point disposed closer to a heel region of the footwear than the anterior-most point. The plate also includes a metatarsophalangeal (MTP) point disposed between the anterior-most point and the posterior-most point and an anterior curved region having a radius of curvature extending through the forefoot region and a mid-foot region of the footwear and including a forefoot curved portion extending from the MTP point to the anterior-most point and a mid-foot curved portion extending from the MTP point toward the posterior-most point. The MTP point opposes the MTP joint of a foot during use. Overlapping portions of the first aperture and the second aperture expose a region of the plate.

Implementations of the disclosure may include one or more of the following optional features. In some implementations, the anterior-most point and the posterior-most point are co-planar. The plate may include a posterior curved region disposed within the heel of the region of the footwear. The posterior-most point may be located within the posterior curved region. The mid-foot curved portion may extend from the MTP point to an aft point disposed within the mid-foot region of the footwear between the MTP point and the posterior-most point. The aft point and the anterior-most point may be co-planar. A planar extent of the posterior-most point may be offset relative to the planar extent of the aft point and the anterior-most point.

In some examples, the plate includes a blend portion disposed between and connecting the anterior curved region and the posterior curved region. The blend portion may include a substantially constant curvature. The second aperture defined by the cushioning member may include an apex point disposed within the mid-foot region of the footwear. The second aperture may include a lateral segment extending toward the forefoot region along a lateral side of the footwear from the apex point and a medial segment extending toward the forefoot region along a medial side of the footwear from the apex point. The medial segment of the second aperture defined by the cushioning member may define a peninsular region within the forefoot region of the footwear.

The first aperture defined by the outsole may include an apex point disposed within the mid-foot region of the footwear, a lateral segment extending toward the forefoot region along the lateral side of the footwear from the apex point, and a medial segment extending toward the forefoot region along the medial side of the footwear from the apex point. The apex point of the first aperture defined by the outsole may be disposed closer to the heel region of the footwear than the apex point of the second aperture defined by the cushioning member. Portions of the first aperture defined by the outsole that do not overlap with the second aperture defined by the cushioning member may be operative to expose the cushioning member.

In some examples, the method includes positioning a fluid-filled bladder between the plate and the outsole. Positioning the fluid-filled bladder may include positioning the fluid-filled bladder within a cut-out region formed through the cushioning member. A portion of the cut-out region unoccupied by the fluid-filled bladder may define the second aperture.

In some implementations, the MTP point is located approximately thirty percent (30%) of the total length of the plate from the anterior-most point. A center of the radius of curvature of the anterior curved region may be located at the MTP point. Positioning the plate may include positioning the plate on the cushioning member underneath the strobel. Positioning the plate may also include positioning the plate on the strobel within the interior void. The plate may be visible through the ankle opening.

The method may also include positioning a midsole on the plate within the interior void. The strobel may define a third aperture that overlaps with the overlapping portions of the first aperture and the second aperture to expose the plate. The exposed region of the plate may include the anterior curved region.

The details of one or more implementations of the disclosure are set forth in the accompanying drawings and the description below. Other aspects, features, and advantages will be apparent from the description and drawings, and from the claims.

During jumping movements, an application point of footwear providing the push-off force from the ground surface is located in a forefoot portion of the footwear. The application point of the footwear opposes a metatarsophalangeal (MTP) joint of the foot. A distance between an ankle joint of the athlete and a line of action of the application point providing the push-off force defines a lever arm length about the ankle. A mechanical demand for the ankle plantarflexors (e.g., calf muscles tendon unit) can be based on an impulse at the application point determined by integrating the push-off force over a time interval for which it acts. As the push-off force is a vector quantity, the impulse is also a vector in the same direction as the push-off force. Stiff and flat footwear plates generally increase the mechanical demand at the ankle due to the stiff, flat plates causing the application point with the ground surface to shift anteriorly. As a result, the lever arm distance increases and a resultant impulse (e.g., a sum of a vertical impulse and a horizontal impulse) at the application point increases, due to a corresponding increase of mechanical demand for the ankle plantarflexors. Generally, increasing the horizontal impulse at the application point of the push-off force increases propulsion and acceleration of the footwear to thereby provide longer jumping distances. Implementations herein are directed toward increasing the length of the lever arm from the ankle joint to increase the horizontal impulse portion of resultant impulse at the application point of the footwear by providing a stiff footwear plate that includes a flat and rigid portion opposing the MTP joint.

Referring to FIGS. 1-4, an article of footwear 10 is provided and includes an upper 100 and a sole structure 200 attached to the upper 100. The article of footwear 10 may be divided into one or more portions. The portions may include a forefoot portion 12, a mid-foot portion 14, and a heel portion 16. The forefoot portion 12 may correspond with toes and joints connecting metatarsal bones with phalanx bones of a foot during use of the footwear 10. The forefoot portion 12 may correspond with the MTP joint of the foot. The mid-foot portion 14 may correspond with an arch area of the foot, and the heel portion 16 may correspond with rear portions of the foot, including a calcaneus bone, during use of the article of footwear 10. The footwear 10 may include lateral and medial sides 18, 20, respectively, corresponding with opposite sides of the footwear 10 and extending through the portions 12, 14, 16.

The upper 100 includes interior surfaces that define an interior void 102 that receives and secures a foot for support on the sole structure 200 during use of the article of footwear 10. An ankle opening 104 in the heel portion 16 may provide access to the interior void 102. For example, the ankle opening 104 may receive a foot to secure the foot within the void 102 and facilitate entry and removal of the foot to and from the interior void 102. In some examples, one or more fasteners 106 extend along the upper 100 to adjust a fit of the interior void 102 around the foot while concurrently accommodating entry and removal of the foot therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may include a tongue portion 110 that extends between the interior void 102 and the fasteners 106. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210, a cushioning member 250, and a strobel 220 arranged in a layered configuration. The sole structure 200 (e.g., the outsole 210, the cushioning member 250, and the strobel 220) defines a longitudinal axis L. For example, the outsole 210 engages with a ground surface during use of the article of footwear 10, the strobel 220 attaches to the upper 100, and the cushioning member 250 is disposed therebetween to separate the strobel 220 from the outsole 210. For example, the cushioning member 250 defines a bottom surface 252 opposing the outsole 210 and a top surface 254 disposed on an opposite side of the cushioning member 250 than the bottom surface 252 and opposing the strobel 220. The top surface 254 may be contoured to conform to the profile of the bottom surface (e.g., plantar) of the foot within the interior void 102. In some examples, the sole structure 200 may also incorporate additional layers such as an insole or sockliner, which may reside within the interior void 102 of the upper 100 to receive a plantar surface of the foot to enhance the comfort of the footwear 10. In some examples, the cushioning member 250 defines a sidewall 230 extending around the perimeter of the cushioning member 250 between the bottom surface 252 and the top surface 254 and separates the outsole 210 and the strobel 220 to define a cavity 240 therebetween. For instance, the sidewall 230 and the top surface 254 of the cushioning member 250 may cooperate to retain and support the foot upon the cushioning member 250 when the interior void 102 receives the foot therein. Here, the sidewall 230 may define a rim around at least a portion of the perimeter of the contoured top surface 254 of the cushioning member 250 to cradle the foot during use of the footwear 10 when performing walking or running movements. The rim may extend around the perimeter of the strobel 220 when the cushioning member 250 attaches to the strobel 220.

In some configurations, a footwear plate 300 is disposed upon the top surface 254 of the cushioning member 250 and underneath the strobel 220 to reduce energy loss at the MTP joint by preventing the MTP joint from absorbing energy through dorsiflexion and increasing force production as the footwear 10 pushes from the ground surface during athletic movements. The footwear plate 300 may define a length extending through at least a portion of the length of the sole structure 200. In some examples, the length of the plate 300 extends through the forefoot, mid-foot, and heel portions 12, 14, 16 of the sole structure 200. In other examples, the length of the plate 300 extends through the forefoot portion 12 and the mid-foot portion 14, and is absent from the heel portion 16. The plate 300 may be substantially stiff and define a geometry that enhances propulsion of the footwear 10 during running and jumping movements. As will become apparent, the geometry of plate 300 is selected to increase a resultant impulse of the footwear 10 when applying the push-off force from the ground surface such that the footwear 10 attains longer horizontal jumping distances compared to a horizontal jumping distance attained footwear that does not include a footwear plate, or footwear incorporating a footwear plate with a substantially flat or more intensified parabolic geometry. More specifically, the geometry of the plate 300 is selected to increase a horizontal impulse for a same given vertical impulse such that the footwear 10 attains the longer horizontal jumping distances. The standard unit for the resultant impulse is a Newton-second (Ns) and takes into consideration both a vertical impulse, measured in a direction substantially perpendicular to the ground surface, and a horizontal impulse, measured in a direction substantially parallel to the ground surface.

In some examples, the footwear plate 300 includes a uniform local stiffness (e.g., tensile modulus or flexural modulus) throughout the entire surface area of the plate 300. The stiffness of the plate may be anisotropic where the stiffness in one direction across the plate is different from the stiffness in another direction. For instance, the plate 300 may be formed from at least two layers of fibers anisotropic to one another to impart gradient stiffness and gradient load paths across the plate 300. In one configuration, the plate 300 provides a greater longitudinal stiffness (e.g., in a direction along the longitudinal axis L) than a transverse stiffness (e.g., in a direction transverse to the longitudinal axis L). In some configurations, the plate 300 is formed from one or more layers/plies of unidirectional tape. In some examples, each layer in the stack includes a different orientation than the layer disposed underneath. For instance, each layer of unidirectional tape in the stack may be oriented by about 15 degrees (15°) relative to the layer of unidirectional tape disposed underneath. In these configurations, the plate 300 may include a total ply thickness of 16 layers to provide the plate 300 with a substantially uniform thickness. In some examples, the thickness of the plate 300 ranges from about 0.6 millimeter (mm) to about 3.0 mm. In one example, the thickness of the plate is substantially equal to 1.2 mm. The plate 300 may be formed from unidirectional tape including at least one of carbon fibers, aramid fibers, boron fibers, glass fibers, and polymer fibers. In some examples, the one or more materials forming the plate 300 include a flat laminate base material having an axial stiffness equal to about 120 gigapascals (GPa) and a flexural stiffness equal to about 113 GPa. The stiffness of the plate 300 may be selected for a particular wearer based on the wearer's tendon flexibility, calf muscle strength, foot length, body weight, and/or MTP joint flexibility. Moreover, the stiffness of the plate 300 may also be tailored based upon jumping motion of the athlete.

In other configurations, the plate 300 is formed from one or more layers of tows of fibers and/or layers of fibers including at least one of carbon fibers, aramid fibers, boron fibers, glass fibers, and polymer fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the plate 300 may have a tensile strength or flexural strength in a transverse direction substantially perpendicular to the longitudinal axis L.

The outsole 210 may include a ground-engaging surface 212 and an opposite inner surface 214. The outsole 210 may attach to the upper 100. In some examples, the bottom surface 252 of the cushioning member 250 affixes to the inner surface 214 of the outsole and the sidewall 230 extends from the perimeter of the cushioning member 250 and attaches to the strobel 220 or to the upper 100. The example of FIG. 1 shows the outsole 210 attaching to the upper 100 proximate to a tip of the forefoot portion 12. The outsole 210 generally provides abrasion-resistance and traction with the ground surface during use of the article of footwear 10. The outsole 210 may be formed from one or more materials that impart durability and wear-resistance, as well as enhance traction with the ground surface. For example, rubber may form at least a portion of the outsole 210.

The strobel 220 may include a bottom surface 222 and a footbed 224 disposed on an opposite side of the strobel 220 than the bottom surface 222. Stitching 226 or adhesives may secure the strobel 220 to a bottom edge 101 of the upper 100. The footbed 224 may be contoured to conform to a profile of the bottom surface (e.g., plantar) of the foot. The bottom surface 222 may oppose the inner surface 214 of the outsole 210 to define a space therebetween for receiving the cushioning member 250.

Figure 2:
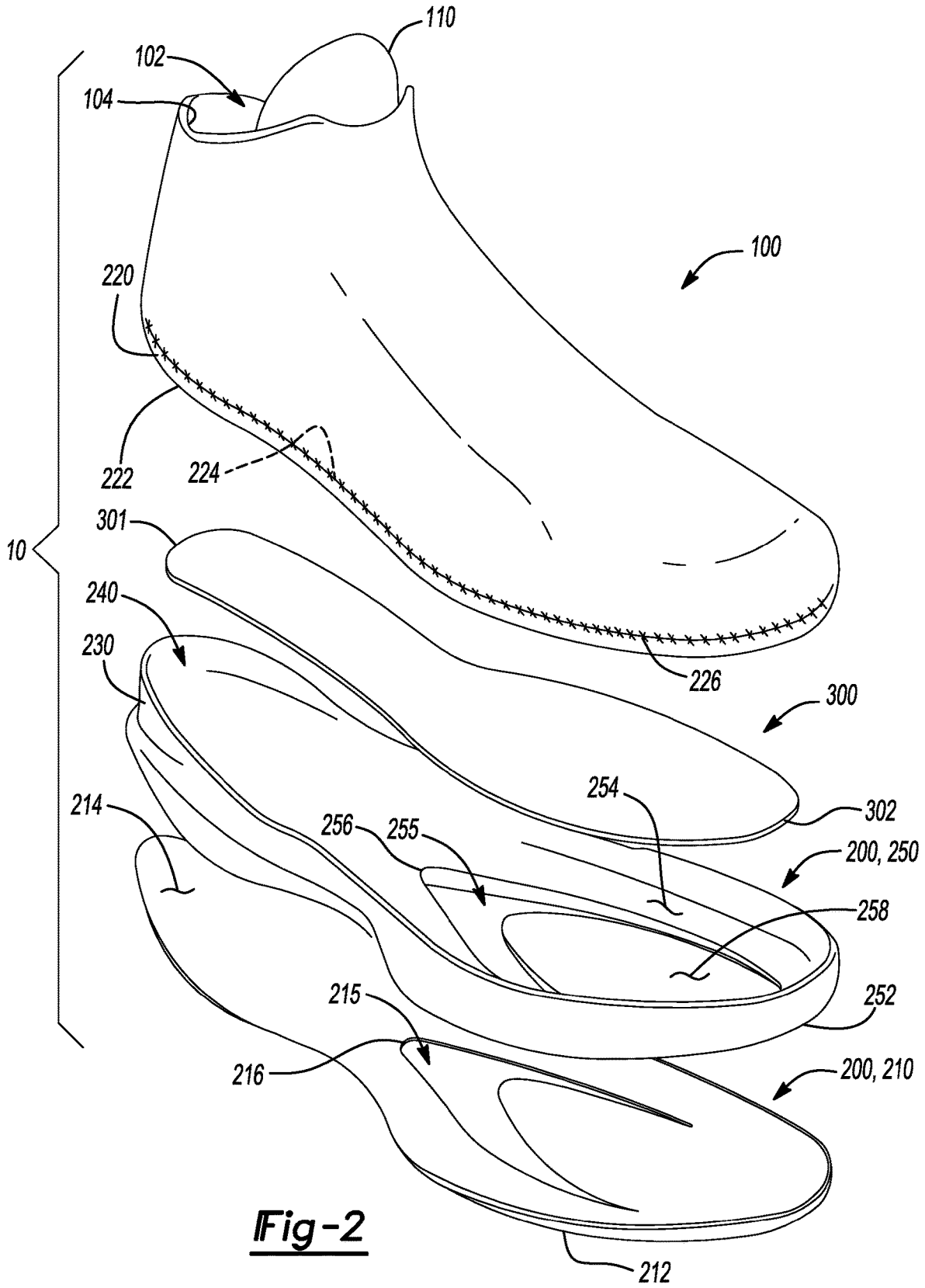
FIG. 2 is an exploded view of the article of footwear of FIG. 1 showing a footwear plate disposed upon a cushioning member within a cavity between an inner surface of an outsole and a bottom surface of a Strobel.

FIG. 2 provides an exploded view of the article of footwear 10 showing the outsole 210, the cushioning member 250 disposed upon the inner surface 214 of the outsole 210, and the substantially rigid footwear plate 300 disposed between the top surface 254 of the cushioning member 250 and the bottom surface 222 of the strobel 220. The strobel 220 attaches to the bottom edge 101 of the upper 100. The cushioning member 250 may be sized and shaped to occupy at least a portion of empty space between the outsole 210 and the strobel 220. Here, the cavity 240 between the cushioning member 250 and the bottom surface 222 of the strobel 220 defines a remaining portion of empty space that receives the footwear plate 300. Accordingly, the cushioning member 250 and the plate 300 may substantially occupy the entire volume of space between the bottom surface 222 of the strobel 220 and the inner surface 214 of the outsole 210. The cushioning member 250 may compress resiliently between the plate 300 and the outsole 210. In some configurations, the cushioning member 250 corresponds to a slab of polymer foam having a surface profile configured to receive the footwear plate 300 thereon. The cushioning member 250 may be formed from any suitable materials that compress resiliently under applied loads. Examples of suitable polymer materials for the foam materials include ethylene vinyl acetate (EVA) copolymers, polyurethanes, polyethers, and olefin block copolymers. The foam can also include a single polymeric material or a blend of two or more polymeric materials including a polyether block amide (PEBA) copolymer, the EVA copolymer, a thermoplastic polyurethane (TPU), and/or the olefin block copolymer. The cushioning member 250 may include a density within a range from about 0.05 grams per cubic centimeter ($g/cm^3$) to about 0.20 $g/cm^3$. In some examples, the density of the cushioning member 250 is approximately 0.1 $g/cm^3$. Moreover, the cushioning member 250 may include a hardness within the range from about eleven (11) Shore A to about fifty (50) Shore A. The one or more materials forming the cushioning member 250 may be suitable for providing an energy return of at least 60-percent (60%).

The length of the footwear plate 300 may extend between a first end 301 and a second end 302. The first end 301 may be disposed proximate to the heel portion 16 of the sole structure 200 and the second end 302 may be disposed proximate to the forefoot portion 12 of the sole structure 200. The first end 301 may also be referred to as a "posterior-most point" of the plate 300 while the second end 302 may also be referred to as an "anterior-most point" of the plate. In some examples, the length of the footwear plate 300 is less than a length of the cushioning member 250. The footwear plate 300 may also include a thickness extending substantially perpendicular to the longitudinal axis L of the sole structure 200 and a width extending between the lateral side 18 and the medial side 20. Accordingly, the length, the width, and the thickness of the plate 300 may substantially occupy the cavity 240 defined by the top surface 254 of the cushioning member 250 and the bottom surface 222 of the strobel 220 and may extend through the forefoot, mid-foot, and heel portions 12, 14, 16, respectively, of the sole structure 200. The plate 300 may define a surface profile that follows the contours of the bottom surface 222 of the strobel 220. In some examples, the bottom edge 101 of the upper 100 attaches to the strobel 220 via the stitching 226 and a last (not shown) is inserted into the ankle opening 104 of the upper 100 to form the upper 100 around the last to define the interior void 102. Here, the bottom edge 101 of the upper 100 may define a curvature substantially identical to the curvature of a bottom surface of the last. In these examples, the surface profile of the plate 300 may define a curvature contoured to the curvature of the bottom edge 101 of the upper 100 and the curvature of the bottom surface of the last.

Still referring to FIG. 2, the cushioning member 250 defines an aperture 255 formed through the bottom and top surfaces 252, 254 within the forefoot and/or mid-foot portions 12, 14 of the cushioning member 250. In some examples, the aperture 255 is v-shaped including a lateral segment 257 (FIG. 4) and a medial segment 259 (FIG. 4) each extending from an apex point 256. The apex point 256 may be disposed within the mid-foot portion 14 between the lateral side 18 and the medial side 20. For instance, a distance between the apex point 256 and the lateral side 18 of the cushioning member 250 may be substantially equal to a distance between the apex point 256 and the medial side 20 of the cushioning member 250. The lateral segment 257 may extend into the forefoot portion 12 along the lateral side 18 of the cushioning member 250 from the apex point 256. A portion of the cushioning member 250 separates the lateral segment 257 of the aperture 255 and the lateral side 18 thereof. On the other hand, the medial segment 259 may extend into the forefoot portion 12 along the medial side 20 of the cushioning member 250 from the apex point 256. A portion of the cushioning member 250 separates the medial segment 259 of the aperture 255 and the medial side 20 thereof. In some configurations, the lateral and medial segments 257, 259 of the aperture 255 cooperate to define a peninsular region 258 of the cushioning member 250 within the forefoot portion 12 of the sole structure 200. Moreover, a sidewall 253 (FIG. 3) defining the aperture 255 may taper from the top surface 254 to the bottom surface 252 of the cushioning member 250. For instance, the sidewall 253 may taper from the top surface 254 in a direction away from interior regions (e.g., the peninsular region 258) of the cushioning member 250 and toward the bottom surface 252 thereof.

The outsole 210 also defines a corresponding aperture 215 formed through the ground-engaging and inner surfaces 212, 214 within the forefoot and/or mid-foot portions 12, 14 of the outsole 210. As with the aperture 255 formed through the cushioning member 250, the aperture 215 formed through the outsole 210 may be v-shaped and include a lateral segment 217 (FIG. 4) and a medial segment 219 (FIG. 4) each extending from an apex point 216 of the aperture 215. The apex point 216 may be disposed within the mid-foot portion 14 of the outsole 210 between the lateral side 18 and the medial side 20. For example, a distance between the apex point 216 and the lateral side 18 of the outsole 210 may be substantially equal to a distance between the apex point 216 and the medial side 20 of the outsole 210. The shapes of the apertures 215, 255 may not be identical. For instance, the lateral segment 217 of the aperture 215 formed through the outsole 210 may extend closer to the lateral side 18 of the sole structure 200 than the lateral segment 257 of the aperture 255 formed through the cushioning member 255, and/or the medial segment 219 of the aperture 215 formed through the outsole 210 may extend closer to the medial side 20 of the sole structure 200 than the medial segment 259 of the aperture 255 formed through the cushioning member 255. In some examples, the apex point 216 for the aperture 215 formed through the outsole 210 is disposed closer to the heel portion 16 than the apex point 256 for the aperture 255 formed through the cushioning member 250.

Figure 3:
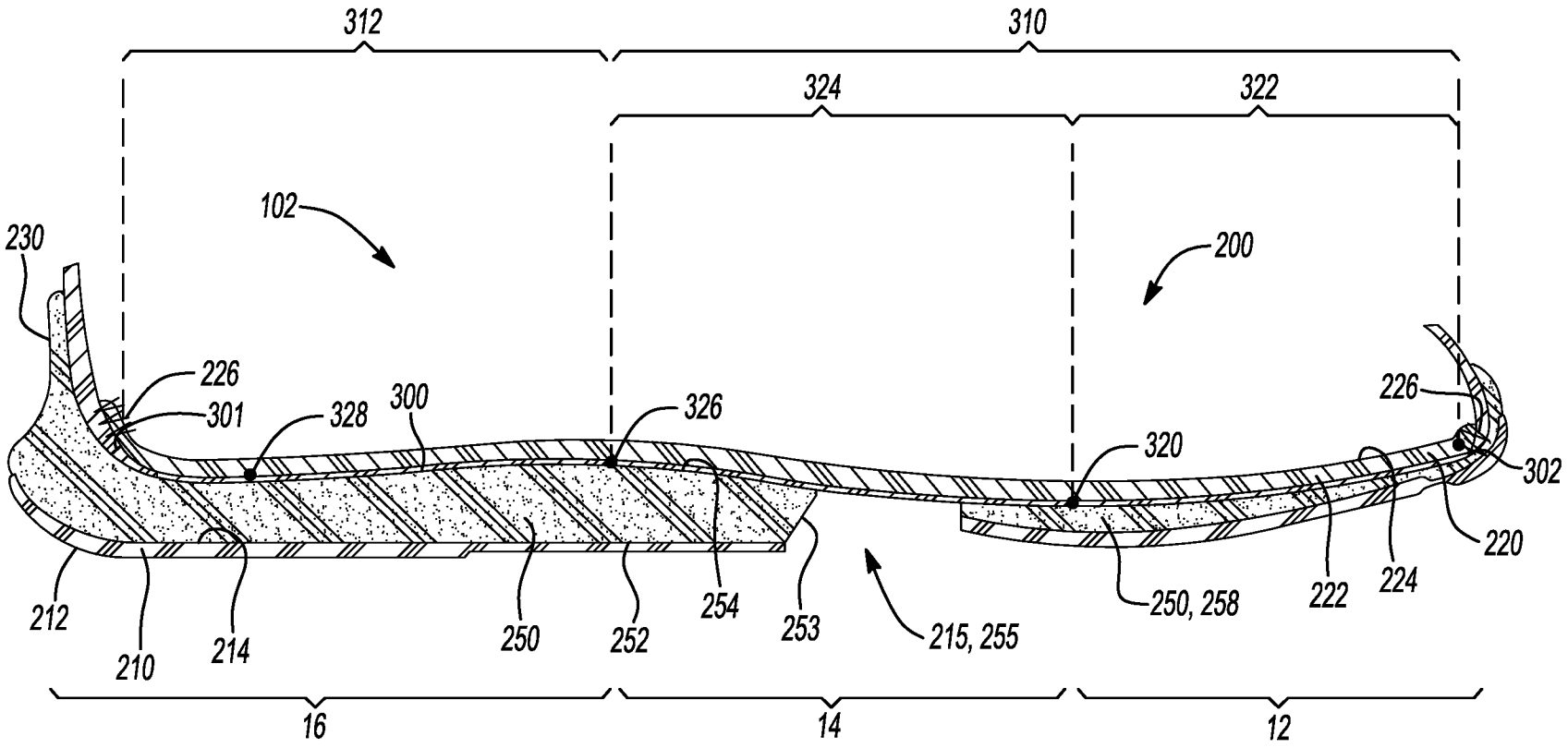
FIG. 3 is a cross-sectional view taken along line 3-3 of FIG. 1 showing a footwear plate disposed upon a cushioning member within a cavity between an inner surface of an outsole and a bottom surface of a Strobel.
Figure 4:
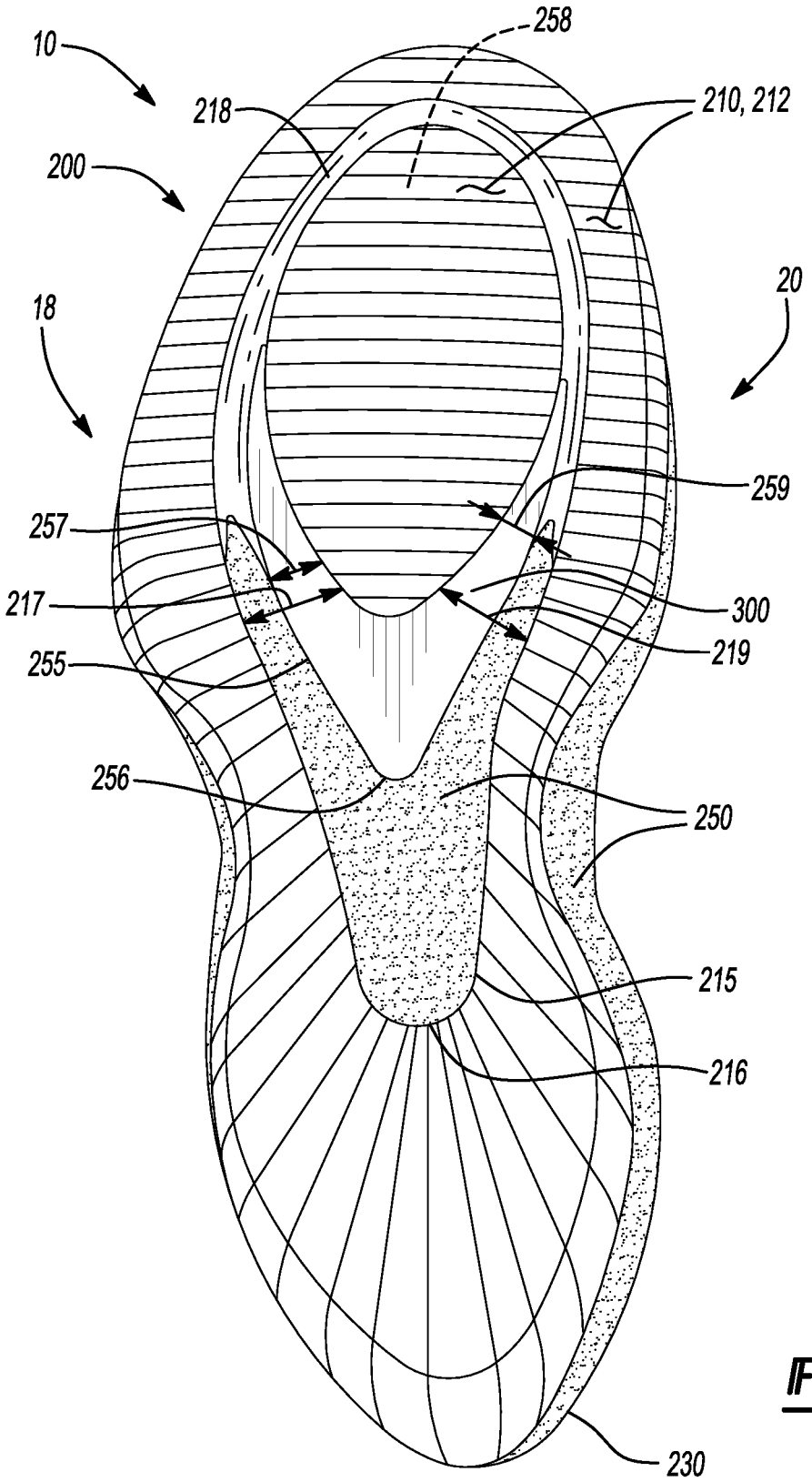
FIG. 4 is a bottom view of the article of footwear of FIG. 1 showing an outsole and a cushioning member each defining apertures that align with one another to expose a footwear plate disposed on the cushioning member.

With reference to FIGS. 3 and 4, overlapping portions of the apertures 215, 255 formed through corresponding ones of the outsole 210 and the cushioning member 250 provide a region where the plate 300 is exposed relative to the view from the bottom of the footwear 10. Moreover, as the apex point 216 for the aperture 215 formed through the outsole 210 is offset relative to the apex point 256 of the aperture 255 formed through the cushioning member 250, portions of the aperture 215 formed through the outsole 210 may expose portions of the cushioning member 250 that are obstructing the footwear plate 300.

FIG. 3 provides a partial cross-sectional view taken along line 3-3 of FIG. 1 showing the footwear plate 300 disposed between the cushioning member 250 and the strobel 220 and the cushioning member 250 disposed between the outsole 210 and the footwear plate 300. Portions of the footwear plate 300 may attach (e.g., via bonding and/or adhesives) to the top surface 254 of the cushioning member 250. The footwear plate 300 is exposed, or otherwise visible relative to the view from the bottom of the footwear 10, in the region where the aperture 215 formed through the outsole 210 aligns (e.g., in a direction substantially perpendicular to the longitudinal axis L) with the aperture 255 formed through the cushioning member 255. Moreover, portions of the aperture 215 formed through the outsole 210 that do not align with the aperture 255 formed through the cushioning member 250 may expose the cushioning member 250 while the cushioning member 250 obstructs the plate 300. For example, the tapering sidewall 253 extending between the top surface 254 and the bottom surface 252 of the cushioning member 250 may obstruct the footwear plate 300 from view, while the aperture 215 formed through the outsole 210 may expose the tapering sidewall 253. FIG. 3 shows the peninsular region 258 of the cushioning member 250 within the forefoot portion 12 of the sole structure 200 enclosed by the outsole 210 along the bottom surface 252. Here, the outsole 210 terminates adjacent to the bottom surface 252 of the cushioning member 250 such that the outsole 210 is separated from the plate 300 by a distance substantially equal to the thickness of the cushioning member 250 within the peninsular region 258. Accordingly, the outsole 210 does not wrap around or encapsulate walls or edges of the cushioning member 250 that extend between the bottom surface 252 and the top surface 254 and oppose the aperture 255.

The cushioning member 250 may define a greater thickness in the heel portion 16 of the sole structure 200 than in the forefoot portion 12. In other words, the gap or distance separating the outsole 210 and the strobel 220 decreases in a direction along the longitudinal axis L of the sole structure 200 from the heel portion 16 toward the forefoot portion 12. In some implementations, the top surface 254 of the cushioning member 250 is smooth and includes a surface profile contoured to match the surface profile of the footwear plate 300 such that the footwear plate 300 and the cushioning member 250 mate flush with one another. In some examples, terminal edges of the outsole 210 that define the aperture 215 may terminate proximate to the bottom surface 252 of the cushioning member 250 such that the terminal edges of the outsole 210 are spaced apart from the strobel 220 by a distance substantially equal to the thickness of the cushioning member 250.

The footwear plate 300 includes a surface profile contoured to the curvature of the bottom edge 101 of the upper 100 such that the footwear plate 300 is substantially equidistant from the bottom edge 101 of the upper 100 along the entire length of the footwear plate 300. The footwear plate 300 includes an anterior curved region 310 extending through the forefoot portion 12 and the mid-foot portion 14 of the sole structure 200, and an optional posterior curved region 312 through the heel portion 16 from the anterior curved region 310 to the posterior-most point 301 of the plate 300. The anterior curved region 310 is associated with a radius of curvature about an MTP point 320 to define a forefoot curved portion 322 extending from one side of the MTP point 320 and a mid-foot curved portion 324 extending from the other side of the MTP point 320. For instance, forefoot curved portion 322 extends between the MTP point 320 and the anterior-most point (AMP) 302 (e.g., second end 302) of the plate 300, while the mid-foot curved portion 324 extends between the MTP point 320 and an aft point 326 disposed at a junction of the anterior curved region 310 and the posterior curved region 312. In some examples, the forefoot curved portion 322 and the mid-foot curved portion 324 are associated with the same radius of curvature that is mirrored about the MTP point 320. In other examples, the forefoot curved portion 322 and the mid-foot curved portion 324 are each associated with a different radius of curvature. In some configurations, a portion of the mid-foot curved portion 324 is associated with the same radius of curvature as the forefoot curved portion 322. Accordingly, the curved portions 322, 324 may each include a corresponding radius of curvature that may be the same or may be different from one another. The posterior curved region 312 is associated with a radius of curvature about a calcaneus point 328. In some examples, the plate 300 further defines a radius of curvature (e.g. blend portion 329 of FIG. 20) that connects the mid-foot curved portion 324 to the posterior region 312 of the plate 300. In some configurations, the posterior curved portion 312 is omitted entirely or defines a substantially flat surface profile. The anterior and posterior curved regions 310, 312, respectively, provide the plate 300 with a longitudinal stiffness that reduces energy loss and shifts the center of pressure anteriorly as the foot flexes through dorsiflexion such that a horizontal impulse portion of a resultant impulse increases when the foot pushes off of the ground surface to thereby increase a horizontal jump distance by the foot during running and/or jumping movements.

The MTP point 320 is the closest point of the footwear plate 300 to the inner surface 214 of the outsole 210 while the posterior-most point (PMP) 301, the calcaneus point 328, the aft point 326, and the AMP 302 of the plate 300 are disposed further from the outsole 210 than the MTP point 320. In some examples, the MTP point 320 of the plate 300 is disposed directly below the MTP joint of the foot and the calcaneus point 328 is disposed directly below the calcaneus bone (e.g., heel bone) of the foot when the foot is received within the interior void 102 of the upper 100. In other examples, the MTP point 320 is disposed at a location that is further from a toe end of the sole structure 200 than the MTP joint. In addition to increasing the resultant impulse of the plate 300 for increasing the jump distance, the forefoot curved and mid-foot curved portions 322, 324, respectively, of the anterior curved region 310 may enhance rolling of the foot during running motions to thereby reduce a lever arm distance and alleviate strain on the ankle joint.

FIG. 4 provides a bottom view of the article of footwear 10 of FIG. 1 showing the footwear plate 300 exposed/visible in the regions where the aperture 215 formed through the outsole 210 overlaps with the aperture 255 formed through the cushioning member 255. FIG. 4 also shows non-overlapping portions of the aperture 215 operative to expose portions of the cushioning member 250 which are obstructing the plate 300 from view. In some examples, the portions of the cushioning member 250 exposed by the aperture 215 include portions of the tapered sidewall 253 that extends between the top and bottom surfaces 254, 252 of the cushioning member 250 to define the aperture 255 formed therethrough.

In some implementations, the outsole 210 defines a semi-elliptical groove 218 within the forefoot portion 12 that extends from terminal ends of the lateral and medial segments 217, 219, respectively, of the aperture 215 to surround an interior region of the outsole 210 that obstructs the peninsular region 258 of the cushioning member 250. Accordingly, the semi-elliptical groove 218 may obstruct portions of the lateral and medial segments 257, 259, respectively, of the aperture 255 that surrounds the peninsular region 258 of the cushioning member 250. The semi-elliptical groove 218 may impart flexibility to the outsole 210 to allow the peninsular region 258 of the cushioning member 250 to compress and thereby provide cushioning for the foot at the point of application of the push-off force from the ground surface. While the cushioning member 250 provides cushioning for the foot as the foot flexes through dorsiflexion, the longitudinal stiffness of the footwear plate 300 simultaneously provides an energy return to propel the foot forward and, thus, attain longer jumping distances compared to that of footwear that does not incorporate a footwear plate, or footwear incorporating a footwear plate with a more extreme parabolic geometry.

FIGS. 5-8 provide an article of footwear 10*a* that includes an upper 100 and a sole structure 200*a* attached to the upper 100. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

Figure 6:
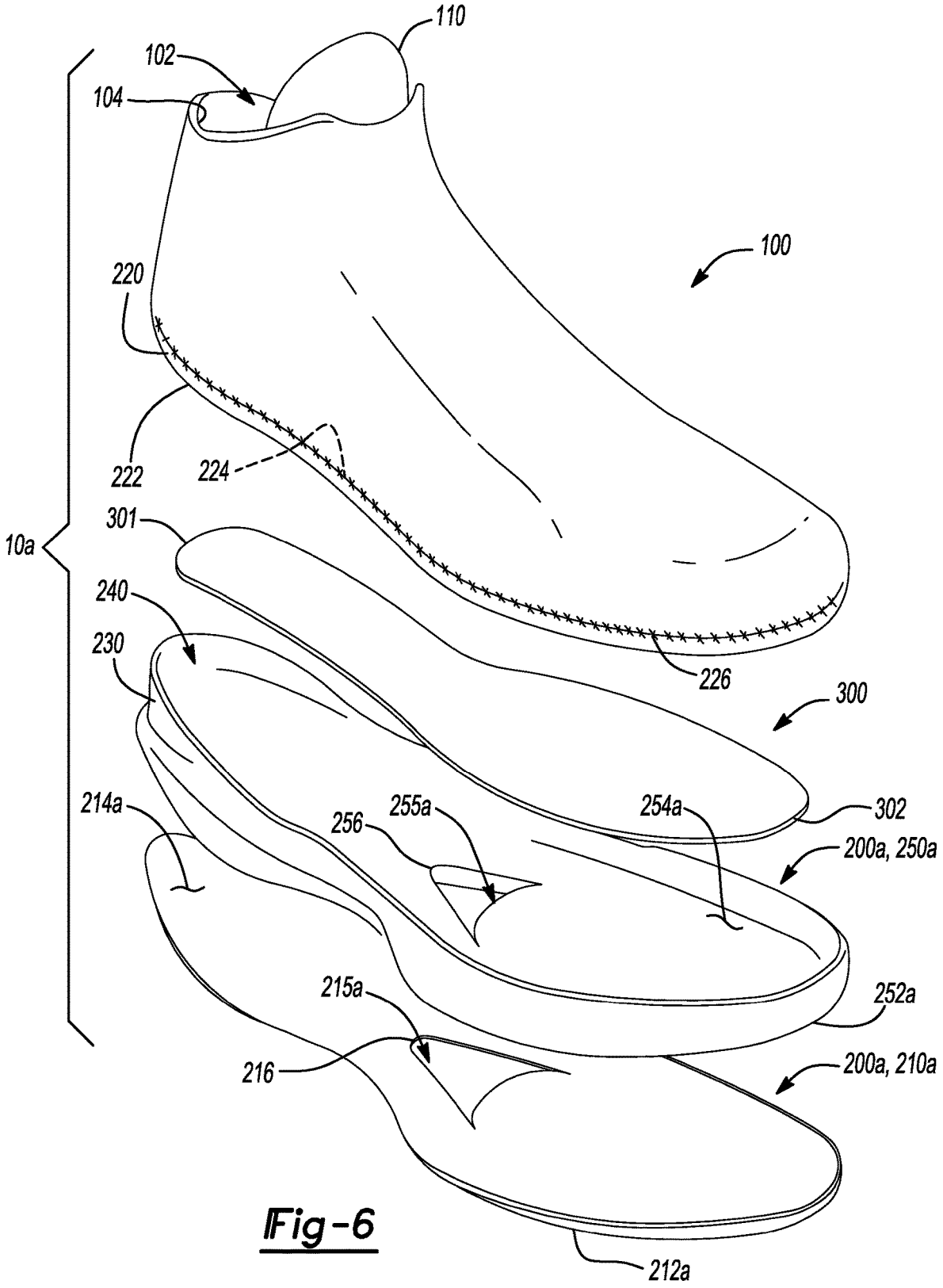
FIG. 6 is an exploded view of the article of footwear of FIG. 5 showing a footwear plate disposed upon a cushioning member within a cavity between an inner surface of an outsole and a bottom surface of a strobel.

The sole structure 200*a* may include an outsole 210*a*, a cushioning member 250*a*, the footwear plate 300, and the strobel 220 arranged in the layered configuration. FIG. 6 provides an exploded view of the article of footwear 10*a* showing the sole structure 200*a* (e.g., the outsole 210*a*, the cushioning member 250*a*, the plate 300, and the strobel 220) defining a longitudinal axis L. The outsole 210*a* includes an inner surface 214*a* disposed on an opposite side of the outsole 210*a* than a ground-engaging surface 212*a*. The cushioning member 250*a* and the footwear plate 300 are disposed between the inner surface 214*a* of the outsole 210*a* and the bottom surface 222 of the strobel 220 to separate the strobel 220 from the outsole 210*a*. The cushioning member 250*a* and the plate 300 may substantially occupy the entire volume of space between the bottom surface 222 of the strobel 220 and the inner surface 214*a* of the outsole 210*a*. For example, the cushioning member 250*a* includes a bottom surface 252*a* received by the inner surface 214*a* of the outsole 210*a* and a top surface 254*a* disposed on an opposite side of the cushioning member 250*a* than the bottom surface 252*a* and opposing the strobel 220 to support the footwear plate 300 thereon. As with the cushioning member 250 of FIGS. 1-4, the cushioning member 250*a* may define the sidewall 230 surrounding at least a portion of a perimeter of the cushioning member 250*a*. The sidewall 230 may define the rim that extends around the perimeter of the strobel 220 when the cushioning member 250*a* attaches to the strobel 220. Moreover, portions of the footwear plate 300 may attach (e.g., via bonding and/or adhesives) to the top surface 254*a* of the cushioning member 250*a*.

The cushioning member 250*a* may compress resiliently between the plate 300 and the outsole 210*a*. The cushioning member 250*a* may be formed from a slab of polymer foam which may be formed from the same one or more materials forming the cushioning member 250 of FIGS. 1-4. For instance, the cushioning member 250*a* may be formed from one or more of EVA copolymers, polyurethanes, polyethers, olefin block copolymers, PEBA copolymers, and/or TPUs. The cushioning member 250*a* may compress resiliently under applied loads to prevent the plate 300 from translating into contact with ground surface while additionally providing a level of soft-type cushioning for the foot to attenuate ground-reaction forces and enhance comfort for the wearer's foot. The footwear plate 300 defines the length extending between the first end 301 (e.g., PMP 301) and the second end 302 (e.g., AMP 302) that may be the same as or less than the length of the cushioning member 250*a*. The length, width, and thickness of the plate 300 may substantially occupy the volume of space between the top surface 254*a* of the cushioning member 250*a* and the bottom surface 222 of the strobel 220 and may extend through the forefoot, mid-foot, and heel portions 12, 14, 16, respectively, of the sole structure 200*a*.

As described above with reference to FIGS. 1-4, the footwear plate 300 may include the uniform local stiffness that may or may not be anisotropic. For instance, the plate 300 may be formed from the one or more layers/plies of unidirectional tape including at least one of carbon fibers, aramid fibers, boron fibers, glass fibers, and polymer fibers. The plate 300 may define a substantially uniform thickness ranging from about 0.6 mm to about 3.0 mm. In one example, the thickness of the plate 300 is substantially equal to 1.2 mm. The stiffness and geometry of the plate 300 may be selected for increasing the resultant impulse at the point of application providing the push-off force from the ground surface to thereby enhance propulsion and increase the horizontal jump distance of the footwear 10*a*.

The cushioning member 250*a* defines an aperture 255*a* formed through the bottom and top surfaces 252*a*, 254*a* within the forefoot and mid-foot portions 12, 14 of the cushioning member 250*a*. In some examples, the aperture 255*a* is arrowhead-shaped and includes the apex point 256 disposed within the mid-foot portion 14 between the lateral side 18 and the medial side 20. The aperture 255*a* is similar to the aperture 255 formed through the cushioning member 250 of FIGS. 1-4 except that the aperture 255*a* omits the lateral segment 257 (FIG. 4) and the medial segment 259 (FIG. 4) extending from the apex point 256, and therefore, the cushioning member 250*a* does not define a peninsular region. A sidewall 253*a* (FIG. 7) defining the aperture 255*a* may taper from the top surface 254*a* in a direction away from interior regions of the cushioning member 250*a* toward the bottom surface 252*a* thereof.

The outsole 210*a* defines a corresponding aperture 215*a* formed through the ground-engaging and inner surfaces 212*a*, 214*a* within the forefoot and mid-foot portions 12, 14 of the outsole 210*a*. The apex point 216 may be disposed within the mid-foot portion 14 of the outsole 210*a* between the lateral side 18 and the medial side 20, and in some examples, the apex point 216 for the aperture 215*a* formed through the outsole 210*a* is disposed closer to the heel portion 16 than the apex point 256 for the aperture 255*a* formed through the cushioning member 250*a*. The aperture 215*a* may be associated with a smaller area compared to the aperture 215 formed through the outsole 210 of FIGS. 1-4.

Figure 7:
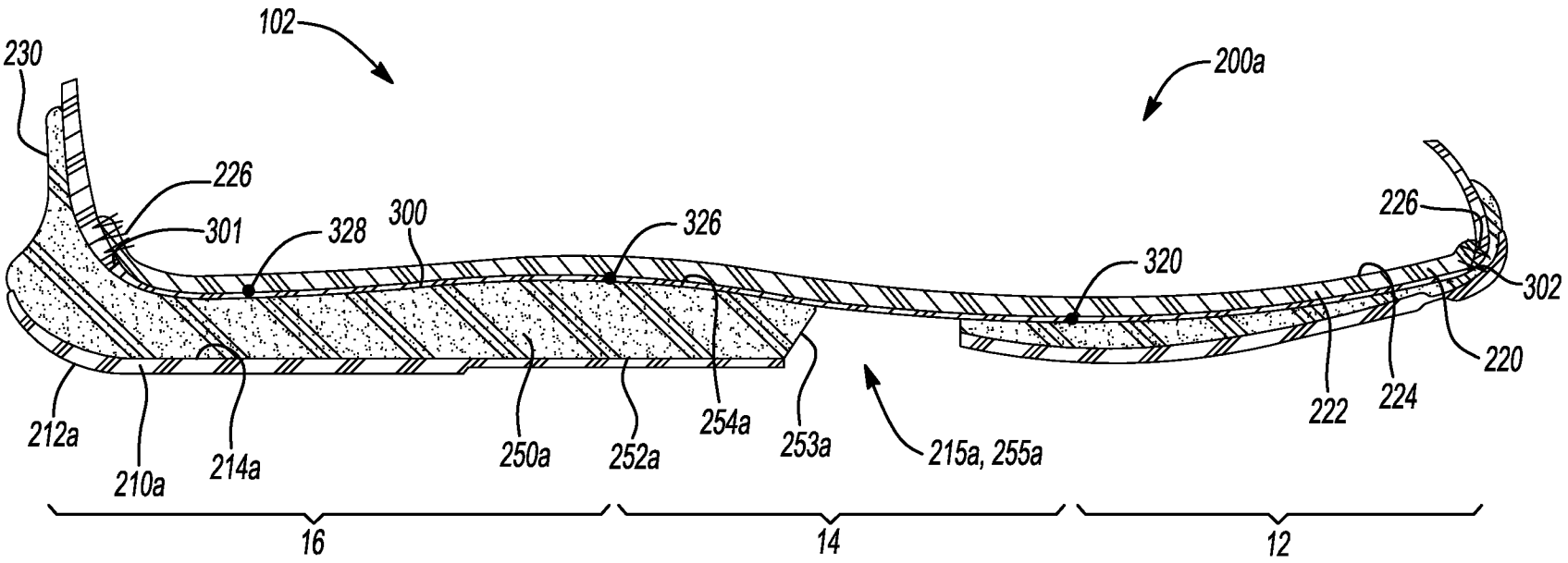
FIG. 7 is a cross-sectional view taken along line 7-7 of FIG. 5 showing a footwear plate disposed upon a cushioning member within a cavity between an inner surface of an outsole and a bottom surface of a strobel.
Figure 8:
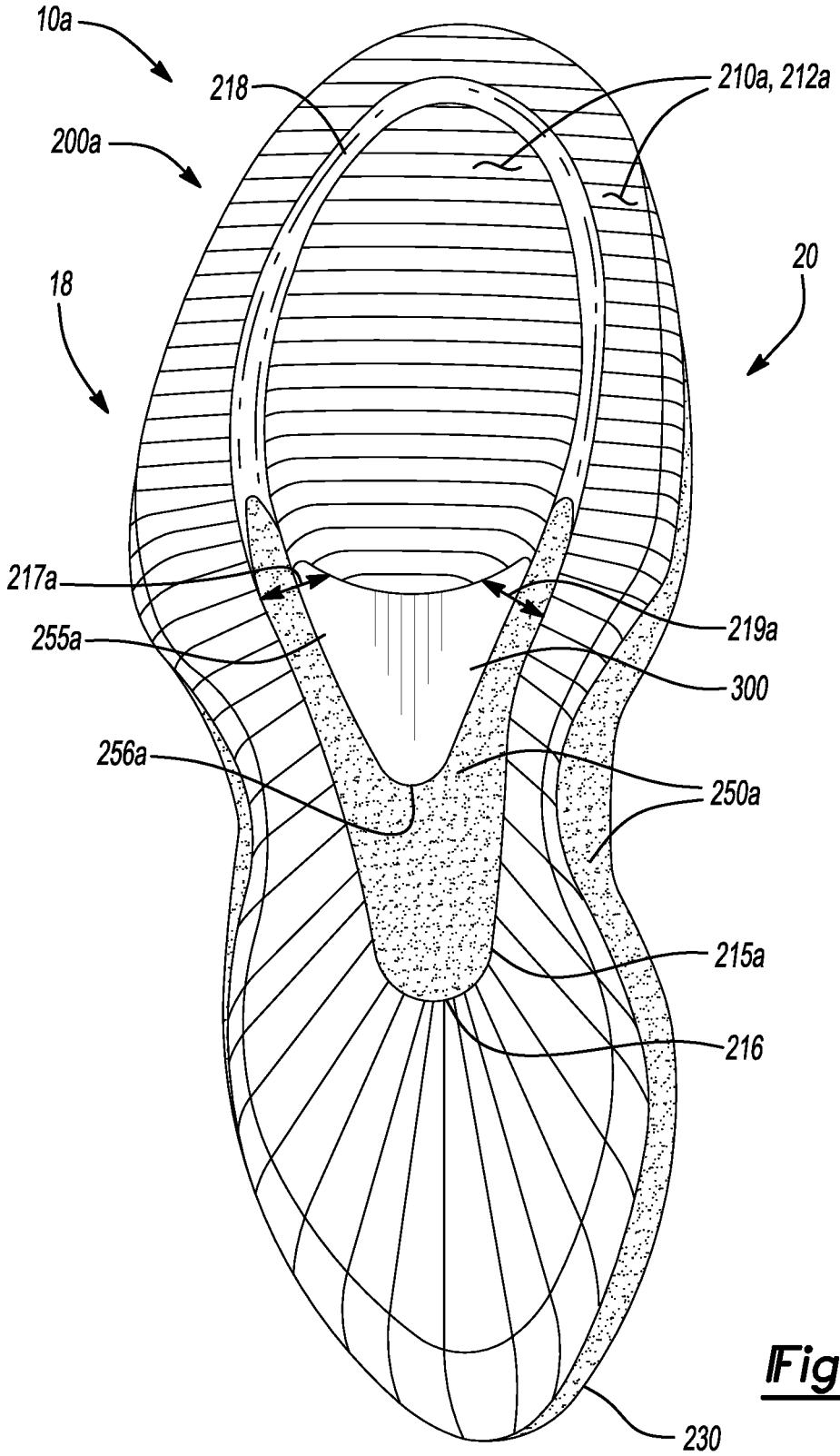
FIG. 8 is a bottom view of the article of footwear of FIG. 5 showing an outsole and a cushioning member each defining apertures that align with one another to expose a footwear plate disposed on the cushioning member.

With reference to FIGS. 7 and 8, overlapping portions of the apertures 215*a*, 255*a* formed through corresponding ones of the outsole 210*a* and the cushioning member 250*a* provide a region where the plate 300 is exposed relative to the view from the bottom of the footwear 10*a*. In some configurations, the aperture 215*a* formed through the outsole 210*a* is associated with a larger area than an area of the aperture 255*a* formed through the cushioning member 250*a*. Accordingly, as the apex point 216 for the aperture 215*a* formed through the outsole 210*a* is offset relative to the apex point 256 of the aperture 255*a* formed through the cushioning member 250*a*, portions of the aperture 215*a* formed through the outsole 210*a* may expose portions of the cushioning member 250*a* that are obstructing the footwear plate 300 relative to the view from the bottom of the footwear 10*a*.

Figure 5:
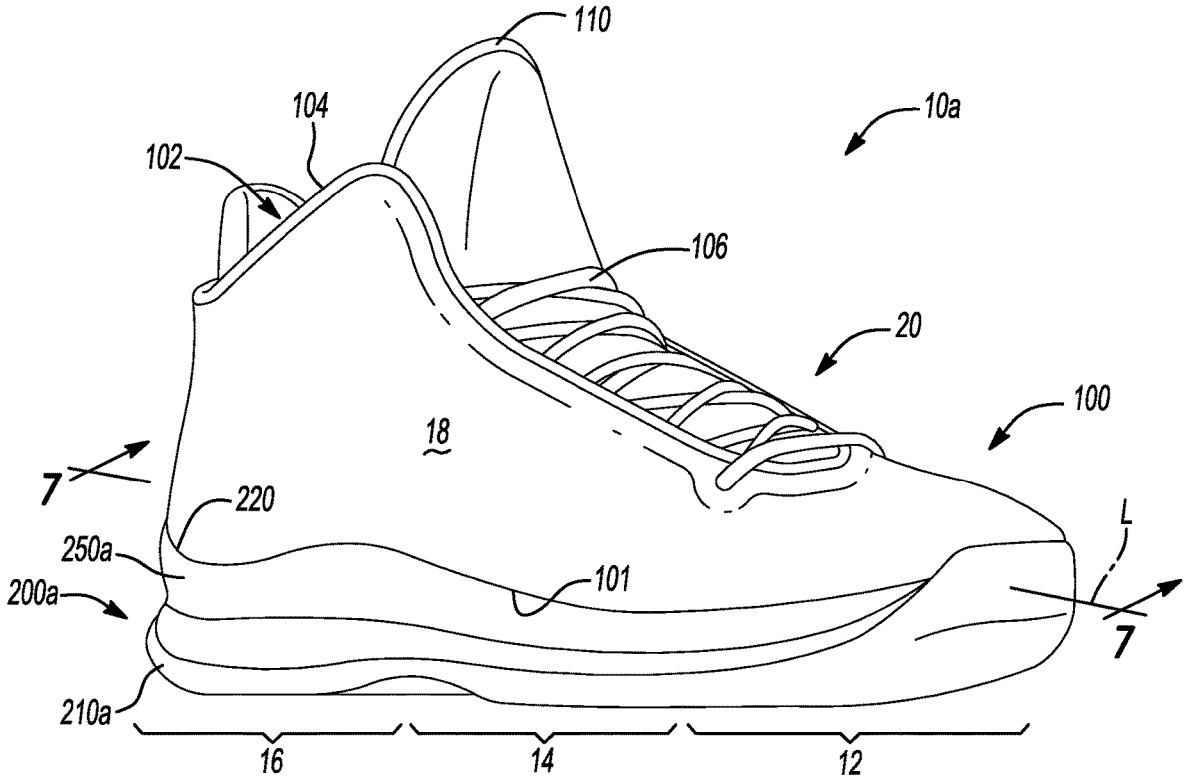
FIG. 5 is a top perspective view of an article of footwear in accordance with principles of the present disclosure.

Referring to FIG. 7, a partial cross-sectional view taken along line 7-7 of FIG. 5 shows the footwear plate 300 disposed between the cushioning member 250*a* and the strobel 220 and the cushioning member 250*a* disposed between the outsole 210*a* and the footwear plate 300. As with the footwear plate 300 of the sole structure 200 of FIGS. 1-4, the footwear plate 300 of the sole structure 200*a* is exposed, or otherwise visible relative to the view from the bottom of the footwear 10*a*, in the region where the aperture 215*a* formed through the outsole 210 aligns/overlaps (e.g., in a direction substantially perpendicular to the longitudinal axis L) with the aperture 255*a* formed through the cushioning member 255*a*. Conversely, the portions of the aperture 215*a* that do not align or overlap with the aperture 255*a* formed through the cushioning member 250*a* exposes the bottom surface 252*a* of the cushioning member 250*a* while the cushioning member 250*a* is obstructing the view of the plate 300. For instance, the tapering sidewall 253*a* extending between the top surface 254*a* and the bottom surface 252*a* of the cushioning member 250*a* effectively obstructs the footwear plate 300 from view, while the aperture 215*a* formed through the outsole 210*a* may expose at least a portion of the tapering sidewall 253*a*. Aside from the aperture 255*a* formed through the cushioning member 250*a* and the aperture 255 formed through the cushioning member 250 of FIGS. 1-4 defining different geometrical shapes, the cushioning member 250*a* is substantially identical to the cushioning member 250 of FIGS. 1-4 and therefore defines a greater thickness in the heel portion 16 of the sole structure 200*a* than the forefoot portion 12 such that the gap separating the outsole 210*a* and the strobel 220 decreases in the direction along the longitudinal axis L of the sole structure 200*a* from the heel portion 16 to the forefoot portion 12. In some implementations, the top surface 254*a* of the cushioning member 250*a* is smooth and includes a surface profile contoured to match the surface profile of the footwear plate 300 such that the footwear plate 300 and the cushioning member 250*a* mate flush with one another. In some examples, terminal edges of the outsole 210*a* that define the aperture 215*a* may terminate proximate to the bottom surface 252*a* of the cushioning member 250*a* such that the terminal edges of the outsole 210*a* are spaced apart from the strobel 220 by a distance substantially equal to the thickness of the cushioning member 250*a*.

FIG. 8 provides a bottom view of the article of footwear 10*a* of FIG. 5 showing the footwear plate 300 exposed/visible in the regions where the aperture 215*a* formed through the outsole 210*a* overlaps with the aperture 255*a* formed through the cushioning member 250*a*. Moreover, portions of the aperture 215*a* that do not overlap with the aperture 255*a* formed through the cushioning member 250*a* expose portions of the cushioning member 250*a* which are obstructing the plate 300 from view. By contrast to the aperture 255 of the cushioning member 250 of FIGS. 1-4 which includes the lateral and medial segments 257, 259 exposing the plate 300 and defining the peninsular region 258, the aperture 255*a* formed through the cushioning member 250*a* omits the formation of the lateral and medial segments 257, 259 through the top surface 254*a* and the bottom surface 252*a* in place of additional cushioning material. Accordingly, an area of the aperture 255*a* formed through the cushioning member 250*a* is smaller than an area of the aperture 255 formed through the cushioning member 250 of FIGS. 1-4 to thereby reduce the portion of the plate 300 that is visible/exposed relative to the view from the bottom of the footwear 10*a*. Advantageously, the reduced area of the aperture 255*a* reduces a susceptibility for the cushioning member 250*a* to pinch and/or fold in regions proximate to the aperture 255*a* when the cushioning member 250*a* compresses under an applied load. Otherwise, pinching and folding of the cushioning member 250*a* diminishes the ability for the cushioning member 250*a* to attenuate ground-reaction forces, thereby reducing the overall comfort for the wearer's foot during use of the footwear 10*a*. Additionally, pinching and folding of the cushioning member 250*a* may cause the plate 300 to be more prone to translating into contact with the ground surface in response to ground-reaction forces.

The aperture 215*a* formed through the outsole 210*a* includes a lateral segment 217*a* and a medial segment 219*a* extending from the apex point 216. In some implementations, the lateral segment 217*a* and the medial segment 219*a* of the aperture 215*a* are narrower than corresponding ones of the lateral segment 217 and the medial segment 219 of the aperture 215 formed through the outsole 210 of FIGS. 1-4. Additionally or alternatively, a distance the lateral segment 217*a* extends into the forefoot portion 12 of the outsole 210*a* from the apex point 216 may be shorter than a distance the lateral segment 217 extends into the forefoot portion 12 of the outsole 210 of FIGS. 1-4. Similarly, a distance the medial segment 219*a* extends into the forefoot portion 12 of the outsole 210*a* from the apex 216 may be shorter than a distance the medial segment 217 extends into the forefoot portion 12 of the outsole 210 of FIGS. 1-4. The outsole 210*a* may also define the semi-elliptical groove 218 extending from the terminal ends of the lateral and medial segments 217*a*, 219*a*, respectively. The semi-elliptical groove 218 may impart flexibility of the outsole 210*a* when the foot pushes off from the ground surface, while the longitudinal stiffness of the footwear plate 300 simultaneously provides the energy return to propel the foot forward and, thus, attain longer jumping distances compared to that of footwear that does not incorporate a footwear plate, or footwear incorporating a footwear plate with a more extreme parabolic geometry.

FIGS. 9-12 provide an article of footwear 10*b* that includes an upper 100 and a sole structure 200*b* attached to the upper 100. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

Figure 10:
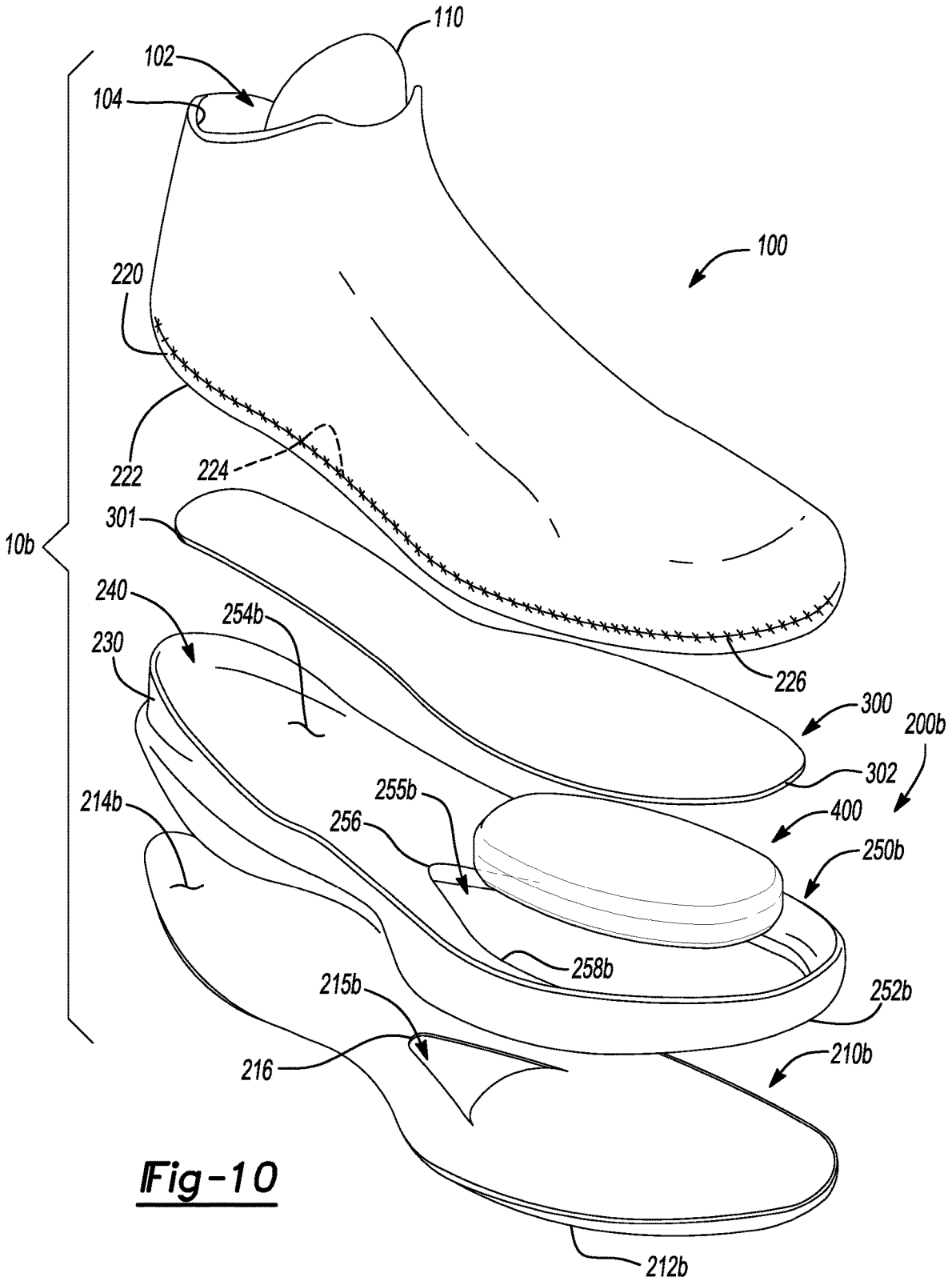
FIG. 10 is an exploded view of the article of footwear of FIG. 9 showing a footwear plate disposed upon a cushioning member and a fluid-filled chamber between an inner surface of an outsole and a bottom surface of a strobel.

The sole structure 200*b* may include an outsole 210*b*, a cushioning member 250*b*, a fluid-filled bladder 400, the footwear plate 300, and the strobel 220 arranged in the layered configuration. FIG. 10 provides an exploded view of the article of footwear 10*b* showing the sole structure 200*b* (e.g., the outsole 210*b*, the cushioning member 250*b*, the fluid-filled bladder 400, the footwear plate 300, and the strobel 220) defining a longitudinal axis L. The outsole 210*b* includes an inner surface 214*b* disposed on an opposite side of the outsole 210*b* than a ground-engaging surface 212*b*. The cushioning member 250*b*, the fluid-filled bladder 400, and the footwear plate 300 are disposed between the inner surface 214*b* of the outsole 210*b* and the bottom surface 222 of the strobel 220 to separate the strobel 220 from the outsole 210*b*. The cushioning member 250*b* and the plate 300 may substantially occupy the entire volume of space between the bottom surface 222 of the strobel 220 and the inner surface 214*b* of the outsole 210*b*. For example, the cushioning member 250*b* includes a bottom surface 252*b* received by the inner surface 214*b* of the outsole 210*b* and a top surface 254*b* disposed on an opposite side of the cushioning member 250*b* than the bottom surface 252*b* and opposing the strobel 220 to support the footwear plate 300 thereon. As with the cushioning member 250 of FIGS. 1-4, the cushioning member 250*b* may define the sidewall 230 surrounding at least a portion of a perimeter of the cushioning member 250*b*. The sidewall 230 may define the rim that extends around the perimeter of the strobel 220 when the cushioning member 250*b* attaches to the strobel 220. The footwear plate 300 may attach (e.g., via bonding and/or adhesives) to the top surface 254*b* of the cushioning member 250*b*.

Moreover, the cushioning member 250*b* defines an internal cut-out region 258*b* formed through the bottom and top surfaces 252*b*, 254*b*, respectively, within the forefoot and mid-foot portions 12, 14 of the cushioning member 250*b*. The internal cut-out region 258*b* defines a volume of space for accommodating the fluid-filled bladder 400. Accordingly, the fluid-filled bladder 400 may reside within the cut-out region 258*b* of the cushioning member 250*b* between the footwear plate 300 and the outsole 210*b* within the forefoot portion 12 of the sole structure 200*b*. Thus, a portion of the footwear plate 300 may be disposed in direct contact with the fluid-filled bladder 400. The fluid-filled bladder 400 may occupy a volume of space substantially equal to the volume of space occupied by the peninsular portion 258 of the cushioning member 250 of FIGS. 1-4. The fluid-filled chamber 400 may be disposed within the forefoot portion 12 of the sole structure 200*b* to enhance cushioning characteristics of the footwear 10*b* responsive to ground-reaction forces. For instance, the fluid-filled bladder 400 may define an interior void that receives a pressurized fluid and provides a durable sealed barrier for retaining the pressurized fluid therein. The pressurized fluid may be air, nitrogen, helium or dense gases such as sulfur hexafluoride. The fluid-filled bladder 400 may additionally or alternatively contain liquids or gels. The cushioning member 250*b* and the fluid-filled bladder 400 may cooperate to enhance functionality and cushioning characteristics when the sole structure 200*b* is under load.

The cushioning member 250*b* may be formed from a slab of polymer foam which may be formed from the same one or more materials forming the cushioning member 250 of FIGS. 1-4. For instance, the cushioning member 250*b* may be formed from one or more of EVA copolymers, polyurethanes, polyethers, olefin block copolymers, PEBA copolymers, and/or TPUs. In some implementations, the cushioning member 250*b* and the fluid-filled bladder 400 impart different types of cushioning characteristics. For example, the fluid-filled bladder 400 may compress resiliently under applied loads to prevent the plate 300 from translating into contact with the ground surface as the foot flexes through dorsiflexion and imparts the push-off force from the ground surface, while the cushioning member 250*b* provides a level of soft-type cushioning for the foot to attenuate ground-reaction forces and enhance comfort for the wearer's foot. The footwear plate 300 defines the length extending between the first end 301 (e.g., PMP 301) and the second end 302 (e.g., AMP 302) that may be the same as or less than the length of the cushioning member 250*b*. The length, width, and thickness of the plate 300 may substantially occupy the volume of space between the top surface 254*b* of the cushioning member 250*b* and the bottom surface 222 of the strobel 220 and may extend through the forefoot, mid-foot, and heel portions 12, 14, 16, respectively, of the sole structure 200*b*.

As described above with reference to FIGS. 1-4, the footwear plate 300 may include the uniform local stiffness that may or may not be anisotropic. For instance, the plate 300 may be formed from the one or more layers/plies of unidirectional tape including at least one of carbon fibers, aramid fibers, boron fibers, glass fibers, and polymer fibers. The plate 300 may define a substantially uniform thickness ranging from about 0.6 mm to about 3.0 mm. In one example, the thickness of the plate 300 is substantially equal to 1.2 mm. The stiffness and geometry of the plate 300 may be selected for increasing the resultant impulse at the point of application providing the push-off force from the ground surface to thereby enhance propulsion and increase the horizontal jump distance of the footwear 10*b*.

With continued reference to FIG. 10, an aperture 255*b* extending through the cushioning member 250*b* is defined by a portion of the internal cut-out region 258*b* that is left unoccupied by the fluid-filled bladder 400. Accordingly, the aperture 255*b* is bounded by the cushioning member 250*b* and an opposing end of the fluid-filled bladder 400. In some examples, the aperture 255*b* is arrowhead-shaped and includes the apex point 256 disposed within the mid-foot portion 14 between the lateral side 18 and the medial side 20 of the cushioning member 250*b*. The aperture 255*b* may define a shape substantially identical to the shape of the aperture 255*a* formed through the cushioning member 250*a* of FIGS. 5-8. A sidewall 253*b* (FIG. 11) of the cushioning member 250*b* that bounds the aperture 255*b* may taper from the top surface 254*b* in a direction away from the internal cut-out region 258*b* of the cushioning member 250*b* toward the bottom surface 252*b* thereof.

The outsole 210*b* defines a corresponding aperture 215*b* formed through the ground-engaging and inner surfaces 212*b*, 214*b* within the forefoot and mid-foot portions 12, 14 of the outsole 210*b*. The apex point 216 may be disposed within the mid-foot portion 14 of the outsole 210*b* between the lateral side 18 and the medial side 20, and in some examples, the apex point 216 for the aperture 215*b* formed through the outsole 210*b* is disposed closer to the heel portion 16 than the apex point 256 for the cut-out region 258*b* (i.e., aperture 255*b*) formed through the cushioning member 250*b*. The aperture 215*b* formed through the outsole 210*b* may include a size and shape substantially identical to a size and shape of the aperture 215*a* formed through the outsole 210*a* of FIGS. 5-8.

Figure 9:
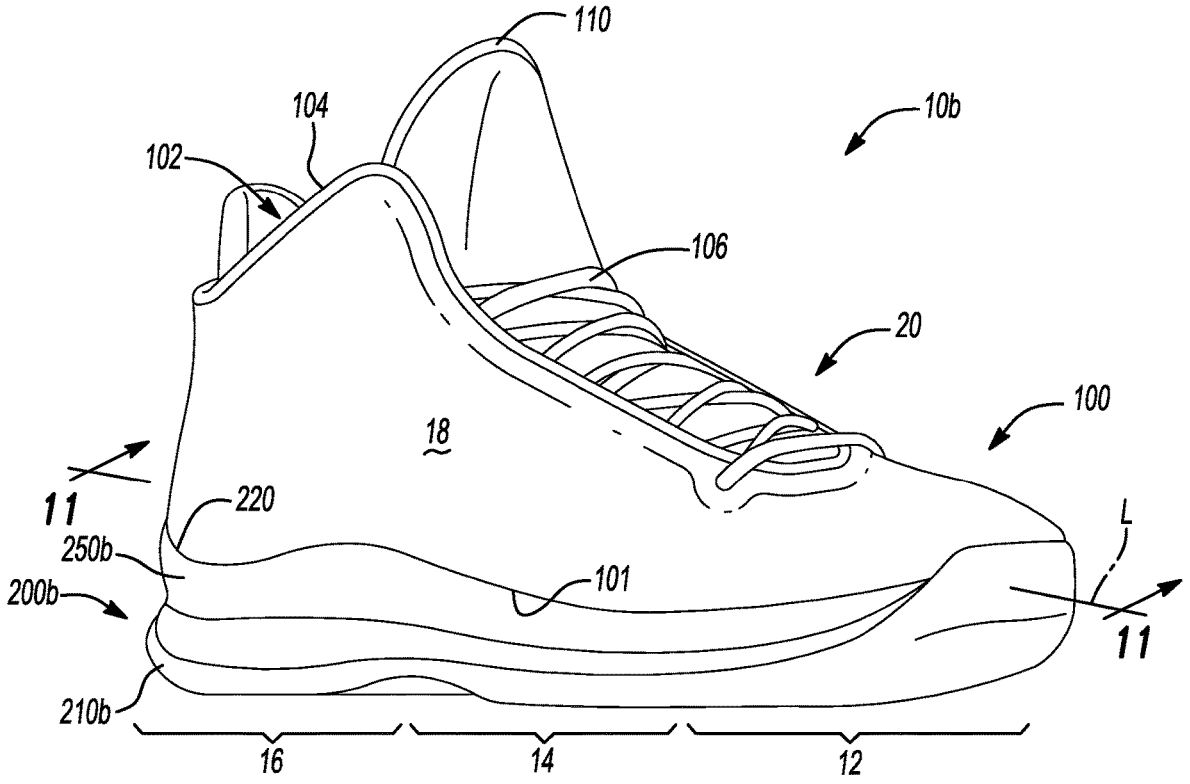
FIG. 9 is a top perspective view of an article of footwear in accordance with principles of the present disclosure.
Figure 11:
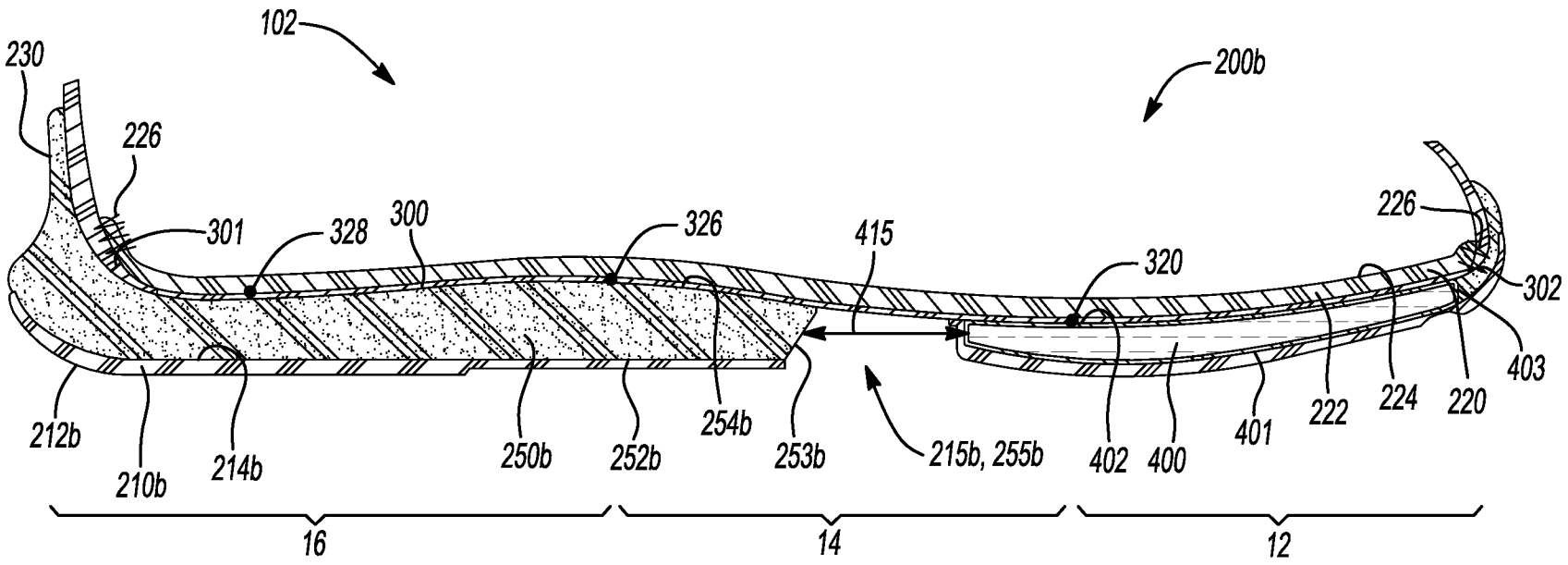
FIG. 11 is a cross-sectional view taken along line 11-11 of FIG. 9 showing a footwear plate disposed upon a cushioning member and a fluid-filled chamber within a cavity between an inner surface of an outsole and a bottom surface of a strobel.

FIG. 11 provides a cross-sectional view taken along line 11-11 of FIG. 9 showing the footwear plate 300 disposed between the cushioning member 250*b* and the strobel 220 within the mid-foot and heel portions 14, 16 of the sole structure 200*b*, and between the fluid-filled bladder 400 and the strobel 220 within the forefoot portion 12 of the sole structure 200*b*. Additionally, the cushioning member 250*b* and the fluid-filled bladder 400 occupying the cut-out region 258*b* of the cushioning member 250*b* are received by the inner surface 214*b* of the outsole 210*b*. The cushioning member 250*b* defines a greater thickness in the heel portion 16 of the sole structure 200*b* compared to a thickness of the fluid-filled bladder 400 disposed in the forefoot portion 12 such that the gap separating the outsole 210*b* and the strobel 220 decreases in the direction along the longitudinal axis L of the sole structure 200*b* from the heel portion 16 to the forefoot portion 12. In some implementations, the top surface 254*b* of the cushioning member 250*b* is smooth and includes a surface profile contoured to match the surface profile of the footwear plate 300 such that the footwear plate 300 and the cushioning member 250*b* mate flush with one another. Moreover, the portions the cushioning member 250*b* residing within the forefoot portion 12 that define the interior cut-out region 258*b* may define a thickness substantially equal to the thickness of the fluid-filled bladder 400. Accordingly, the cushioning member 250*b* and the fluid-filled bladder 400 may cooperate to define a smooth and continuous surface profile contoured to match the surface profile of the footwear plate 300 such that the footwear plate 300 mates flush with the both the cushioning member 250*b* and the fluid-filled bladder 400 within the forefoot portion 12 of the sole structure 200*b*.

The fluid-filled bladder 400 defines an interior cavity that receives the pressurized fluid while providing a durable sealed barrier for retaining the pressurized fluid therein. The bladder 400 may include an upper barrier portion 402 that opposes and contacts a portion of the footwear plate 300 and a lower barrier portion 401 disposed on an opposite side of the bladder 400 than the upper barrier portion 402 and received by the inner surface 214*b* of the outsole 210*b*. A sidewall 403 extends around the periphery of the bladder 400 and connects the upper barrier portion 402 to the lower barrier portion 401.

Figure 12:
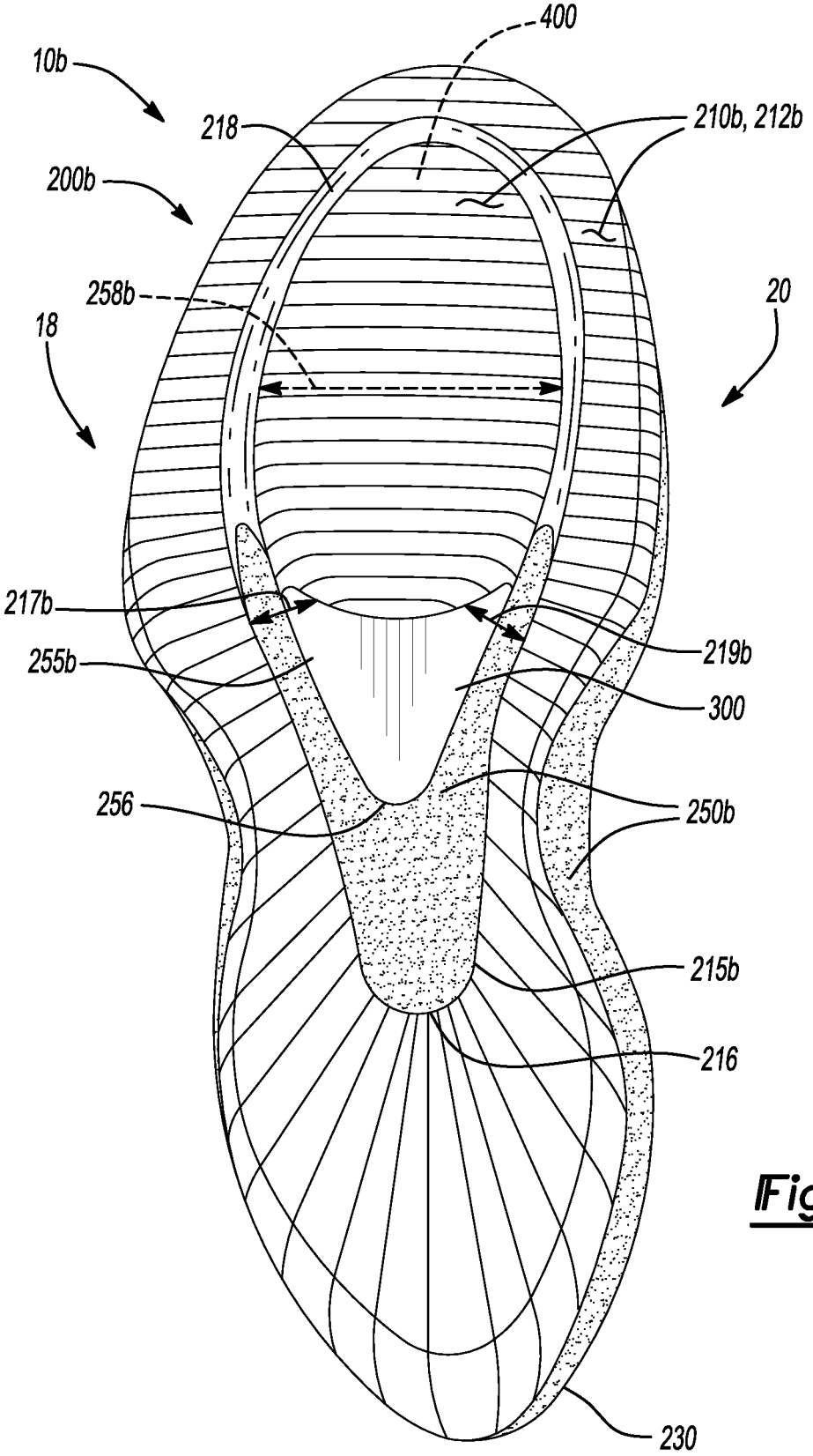
FIG. 12 is a bottom view of the article of footwear of FIG. 9 showing an outsole and a cushioning member each defining apertures that align with one another to expose a footwear plate disposed on the cushioning member.

With reference to FIGS. 11 and 12, the aperture 255*b* associated with the portion of the cut-out region 258*b* unoccupied by the fluid-filled bladder 400 may overlap with a portion of the aperture 215*b* formed through the outsole 210*b* to provide a region 415 where the plate 300 is exposed relative to the view from the bottom of the footwear 10*b*. In some configurations, the aperture 215*b* formed through the outsole 210*b* is associated with a larger area than an area of the aperture 255*b* defined within the cut-out region 258*b* of the cushioning member 255*b*. Accordingly, as the apex point 216 for the aperture 215*b* formed through the outsole 210*a* is offset relative to the apex point 256 of the aperture 255*b* within the cut-out region 258*b* of the cushioning member 250*b*, portions of the aperture 215*b* formed through the outsole 210*b* may expose portions of the cushioning member 250*b* that are obstructing the footwear plate 300 relative to the view from the bottom of the footwear 10*b*. For instance, the tapering sidewall 253*b* extending between the top surface 254*b* and the bottom surface 252*b* of the cushioning member 250*b* effectively obstructs the footwear plate 300 from view, while the aperture 215*b* formed through the outsole 210*b* may expose at least a portion of the tapering sidewall 253*b*. In some examples, terminal edges of the outsole 210*b* that define the aperture 215*b* may terminate proximate to the bottom surface 252*b* of the cushioning member 250*b*, as well as the lower barrier portion 401 of the fluid-filled bladder 400, such that the terminal edges of the outsole 210 are spaced apart from the strobel 220 by a distance substantially equal to the thickness of the cushioning member 250 and the fluid-filled bladder 400.

FIG. 12 provides a bottom view of the article of footwear 10*b* of FIG. 9 showing the footwear plate 300 exposed/visible in the regions where the aperture 215*b* formed through the outsole 210*b* overlaps with the aperture 255*b* within the cut-out region 258*b* of the cushioning member 250*b*. As with the article of footwear 10*a* of FIGS. 5-8, portions of the aperture 215*b* that do not overlap with the aperture 255*b* extending through the cushioning member 250*b* expose portions of the cushioning member 250*b* which are obstructing the plate 300 from view.

As with the aperture 215*a* formed through the outsole 210*a* of FIGS. 5-8, the aperture 215*b* formed through the outsole 210*b* includes a lateral segment 217*b* and a medial segment 219*b* extending from the apex point 216 that are narrower than corresponding ones of the lateral segment 217 and the medial segment 219 of the aperture 215 formed through the outsole 210 of FIGS. 1-4. Additionally, a distance the lateral segment 217*b* extends into the forefoot portion 12 of the outsole 210*b* from the apex 216 may the same as the distance the lateral segment 217*a* extends into the forefoot portion 12 of the outsole 210*a* of FIGS. 5-8, and a distance the medial segment 219*b* extends into the forefoot portion 12 of the outsole 210*b* from the apex 216 may be the same as the distance the medial segment 219*b* extends into the forefoot portion 12 of the outsole 210*a* of FIGS. 5-8.

In some implementations, the outsole 210*b* defines the semi-elliptical groove 218 within the forefoot portion 12 that extends from terminal ends of the lateral and medial segments 217*b*, 219*b*, respectively, of the aperture 215*b* to surround an interior region of the outsole 210*b* that obstructs the fluid-filled bladder 400 received within the cut-out region 258*b* formed through the cushioning member 250. The semi-elliptical groove 218 may impart flexibility to the outsole 210*b* to allow the fluid-filled bladder 400 received by the cut-out region 258*b* of the cushioning member 250*b*, as well as portions of the cushioning member 250*b* surrounding the cut-out region 258*b*, to compress and thereby provide cushioning for the foot at the point of application of the push-off force from the ground surface. While the cushioning member 250*b* provides cushioning for the foot as the foot flexes through dorsiflexion, the longitudinal stiffness of the footwear plate 300 simultaneously provides an energy return to propel the foot forward and, thus, attain longer jumping distances compared to that of footwear that does not incorporate a footwear plate, or footwear incorporating a footwear plate with a flat or parabolic geometry.

FIGS. 13-16 provide an article of footwear 10*c* that includes an upper 100 and a sole structure 200*c* attached to the upper 100. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

Figure 14:
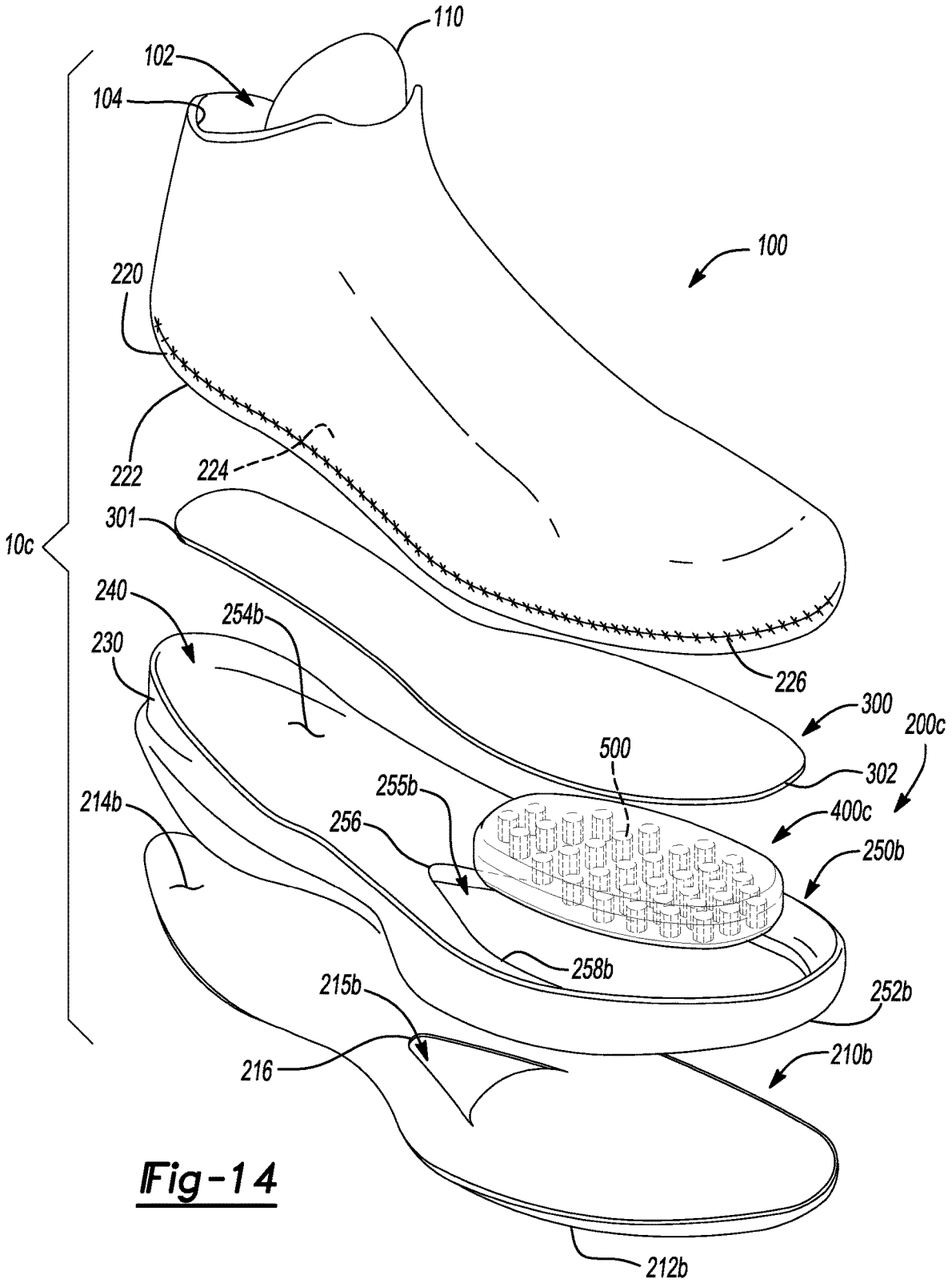
FIG. 14 is an exploded view of the article of footwear of FIG. 13 showing a footwear plate disposed upon a cushioning member and a fluid-filled chamber incorporating a tensile element between an inner surface of an outsole and a bottom surface of a strobel.

The sole structure 200*c* may include the outsole 210*b*, the cushioning member 250*b*, a fluid-filled bladder 400*c*, the footwear plate 300, and the strobel 220 arranged in the layered configuration. FIG. 14 provides an exploded view of the article of footwear 10*c* showing the sole structure 200*c* (e.g., the outsole 210*b*, the cushioning member 250*b*, the fluid-filled bladder 400*c*, the footwear plate 300, and the strobel 220) defining a longitudinal axis L. The outsole 210*b* includes the inner surface 214*b* disposed on the opposite side of the outsole 210*b* than the ground-engaging surface 212*b*. The cushioning member 250*b*, the fluid-filled bladder 400*b*, and the footwear plate 300 are disposed between the inner surface 214*b* of the outsole 210*b* and the bottom surface 222 of the strobel 220 to separate the strobel 220 from the outsole 210*b*. The cushioning member 250*b* and the plate 300 may substantially occupy the entire volume of space between the bottom surface 222 of the strobel 220 and the inner surface 214*b* of the outsole 210*b*. The cushioning member 250*b* may define the sidewall 230 surrounding at least a portion of a perimeter of the cushioning member 250*b*. The sidewall 230 may define the rim that extends around the perimeter of the strobel 220 when the cushioning member 250*b* attaches to the strobel 220.

As with the fluid-filled bladder 400 of the article of footwear of FIGS. 9-12, the fluid-filled bladder 400*c* may reside within the cut-out region 258*b* of the cushioning member 250*b* between the footwear plate 300 and the outsole 210*b* within the forefoot portion 12 of the sole structure 200*c* to enhance cushioning characteristics of the footwear 10 responsive to ground-reaction forces. For instance, an interior cavity of bladder 400*c* may be filled with a pressurized fluid such as air, nitrogen, helium, sulfur hexafluoride, or liquids/gels. In some configurations, the interior cavity of the fluid-filled bladder 400*c* also receives a tether element 500 operative to prevent the bladder 400*c* from expanding outward or otherwise distending due to the pressure of the fluid within the internal cavity of the bladder 400*c*. Namely, the tether element 500 may limit expansion of the bladder 400*c* when under pressure to retain an intended shape of surfaces of the bladder 400*c*.

In some implementations, the cushioning member 250*b* and the fluid-filled bladder 400*c* impart different types of cushioning characteristics. For example, the fluid-filled bladder 400*c* may compress resiliently under applied loads to prevent the plate 300 from translating into contact with the ground surface as the foot flexes through dorsiflexion and imparts the push-off force from the ground surface, while the cushioning member 250*b* provides the level of soft-type cushioning for the foot to attenuate ground-reaction forces and enhance comfort for the wearer's foot. The footwear plate 300 defines the length extending between the first end 301 (e.g., PMP 301) and the second end 302 (e.g., AMP 302) that may be the same as or less than the length of the cushioning member 250*b*. The length, width, and thickness of the plate 300 may substantially occupy the volume of space between the top surface 254*b* of the cushioning member 250*a* and the bottom surface 222 of the strobel 220 and may extend through the forefoot, mid-foot, and heel portions 12, 14, 16, respectively, of the sole structure 200*c*.

As described above with reference to FIGS. 1-4, the footwear plate 300 may include the uniform local stiffness that may or may not be anisotropic. For instance, the plate 300 may be formed from the one or more layers/plies of unidirectional tape including at least one of carbon fibers, aramid fibers, boron fibers, glass fibers, and polymer fibers. The plate 300 may define a substantially uniform thickness ranging from about 0.6 mm to about 3.0 mm. In one example, the thickness of the plate 300 is substantially equal to 1.2 mm. The stiffness and geometry of the plate 300 may be selected for increasing the resultant impulse at the point of application providing the push-off force from the ground surface to thereby enhance propulsion and increase the horizontal jump distance of the footwear 10*c*.

With continued reference to FIG. 14, the arrowhead-shaped aperture 255*b* extends through the cushioning member 250*b* while the remaining portion of the cut-region 258*b* is occupied by the fluid-filled bladder 400*c* such that the aperture 255*b* is bounded by the cushioning member 250*b* one two sides and an opposing end of the fluid-filled bladder 400*c* on the third side. The sidewall 253*b* (FIG. 15) of the cushioning member 250*b* that bounds the aperture 255*b* may taper from the top surface 254*b* in a direction away from the internal cut-out region 258*b* of the cushioning member 250*b* toward the bottom surface 252*b* thereof. The outsole 210*b* defines the corresponding aperture 215*b* formed therethrough and including the apex point 216 disposed within the mid-foot portion of the outsole 210*b* between the lateral side and the medial side 20. The apex point 216 for the aperture 215*b* may be disposed closer to the heel portion 16 than the apex point 256 for the cut-out region 258*b* (i.e., aperture 255*b*) formed through the cushioning member 250*b*.

Figure 13:
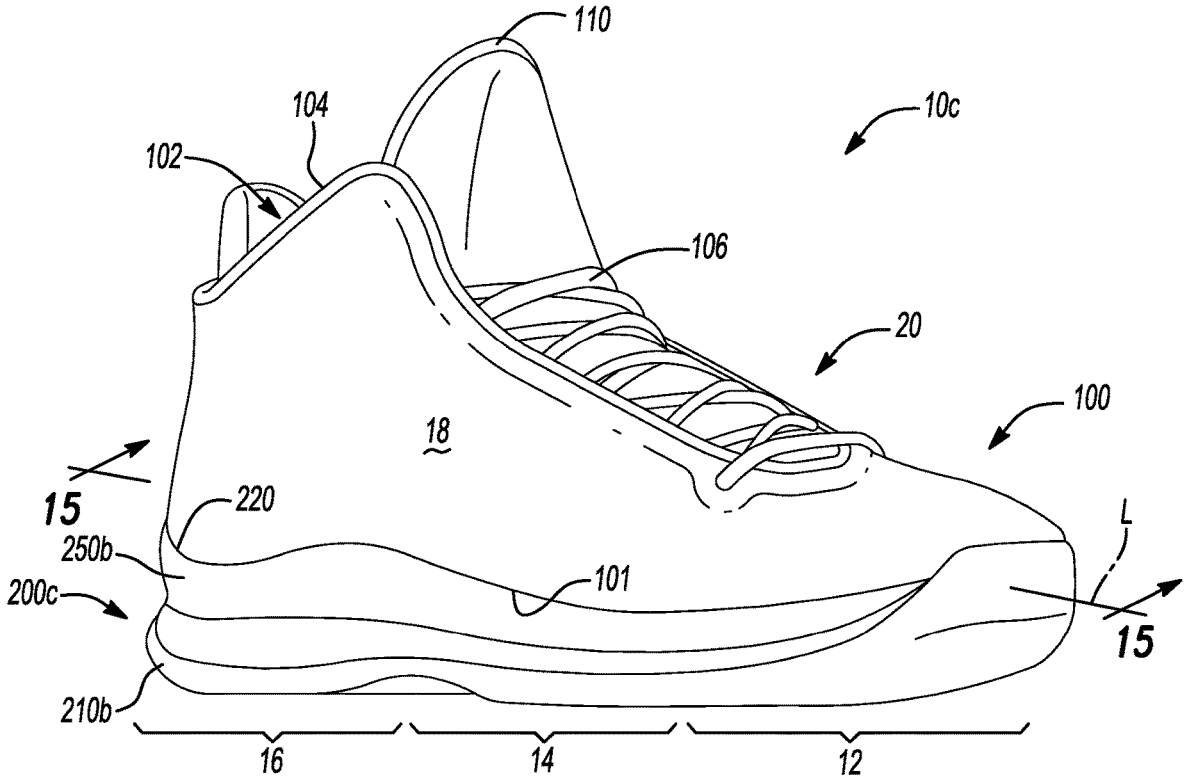
FIG. 13 is a top perspective view of an article of footwear in accordance with principles of the present disclosure.
Figure 15:
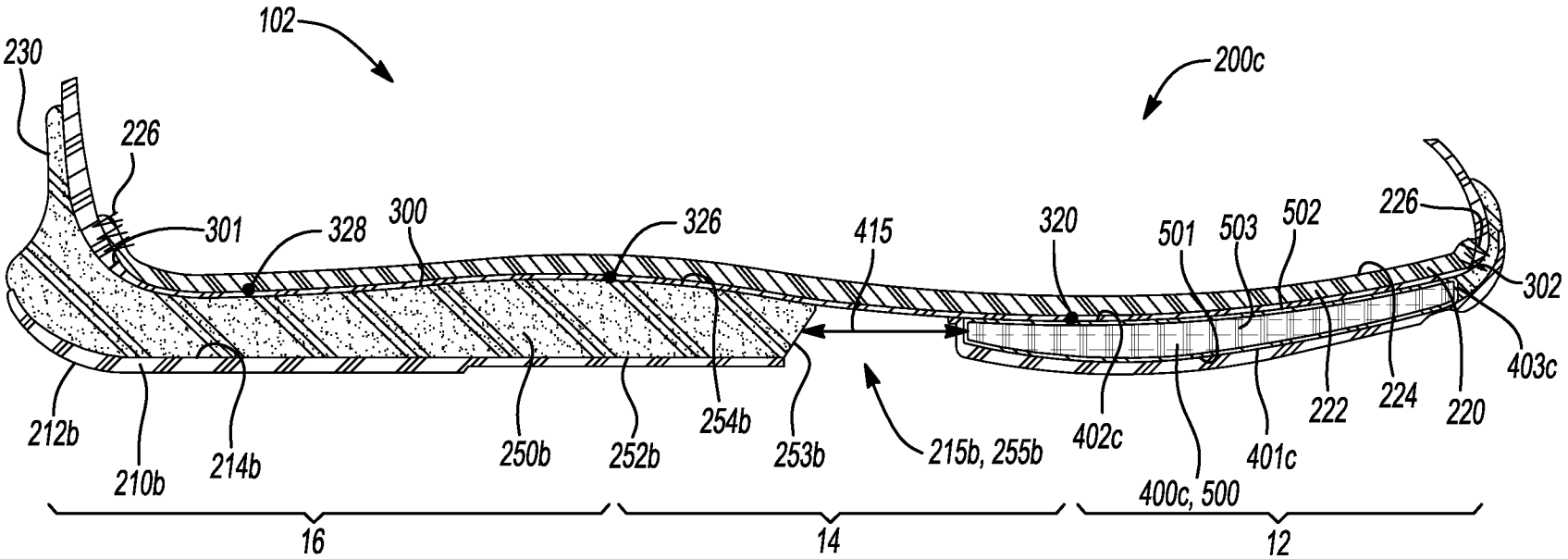
FIG. 15 is a cross-sectional view taken along line 15-15 of FIG. 13 showing a footwear plate disposed upon a cushioning member and a fluid-filled chamber incorporating a tensile element within a cavity between an inner surface of an outsole and a bottom surface of a strobel.

FIG. 15 provides a cross-sectional view taken along line 15-15 of FIG. 13 showing the footwear plate 300 disposed between the cushioning member 250*b* and the strobel 220 within the mid-foot and heel portions 14, 16 of the sole structure 200*c*, and between the fluid-filled bladder 400*c* and the strobel 220 within the forefoot portion 12 of the sole structure 200*c*. Additionally, the cushioning member 250*b* and the fluid-filled bladder 400*c* occupying the cut-out region 258*b* of the cushioning member 250*b* are received by the inner surface 214*b* of the outsole 210*b*. The cushioning member 250*b* defines a greater thickness in the heel portion 16 of the sole structure 200*b* compared to a thickness of the fluid-filled bladder 400*c* disposed in the forefoot portion 12 such that the gap separating the outsole 210*b* and the strobel 220 decreases in the direction along the longitudinal axis L of the sole structure 200*c* from the heel portion 16 to the forefoot portion 12. In some implementations, the portions of the cushioning member 250*b* residing within the forefoot portion 12 that define the interior cut-out region 258*b* define a thickness substantially equal to the thickness of the fluid-filled bladder 400*c*. Accordingly, the cushioning member 250*b* and the fluid-filled bladder 400*c* may cooperate to define a smooth and continuous surface profile contoured to match the surface profile of the footwear plate 300 such that the footwear plate 300 mates flush with the both the cushioning member 250*b* and the fluid-filled bladder 400*c* within the forefoot portion 12 of the sole structure 200*b*.

The bladder 400*c* may include an upper barrier portion 402*c* that opposes and contacts a portion of the footwear plate 300 and a lower barrier portion 401*c* disposed on an opposite side of the bladder 400*c* than the upper barrier portion 402*c* and received by the inner surface 214*b* of the outsole 210*b*. A sidewall 403*c* extends around the periphery of the bladder 400*c* and connects the upper barrier portion 402*c* to the lower barrier portion 401*c*. The tether element 500 received by the interior cavity of the fluid-filled bladder 400*c* includes an upper plate 502 that attaches to the upper barrier portion 402*c*, a lower plate 501 that attached to the lower barrier portion 401*c*, and a plurality of tethers 503 that extend between the lower and upper plates 501, 502 of the tether element 500. Adhesive bonding or thermobonding may be used to secure the tether element 500 to the bladder 400*c*. For instance, the upper plate 502 may attach to the upper barrier portion 402*c* via adhesive bonding or thermobonding and the lower plate 501 may attach to the lower barrier portion 401*c* via adhesive bonding or thermobonding. As set forth above, the tether element 500 is operative to prevent the bladder 400*c* from expanding outward or otherwise distending due to the pressure of the fluid within the internal cavity of the bladder 400*c*.

Figure 16:
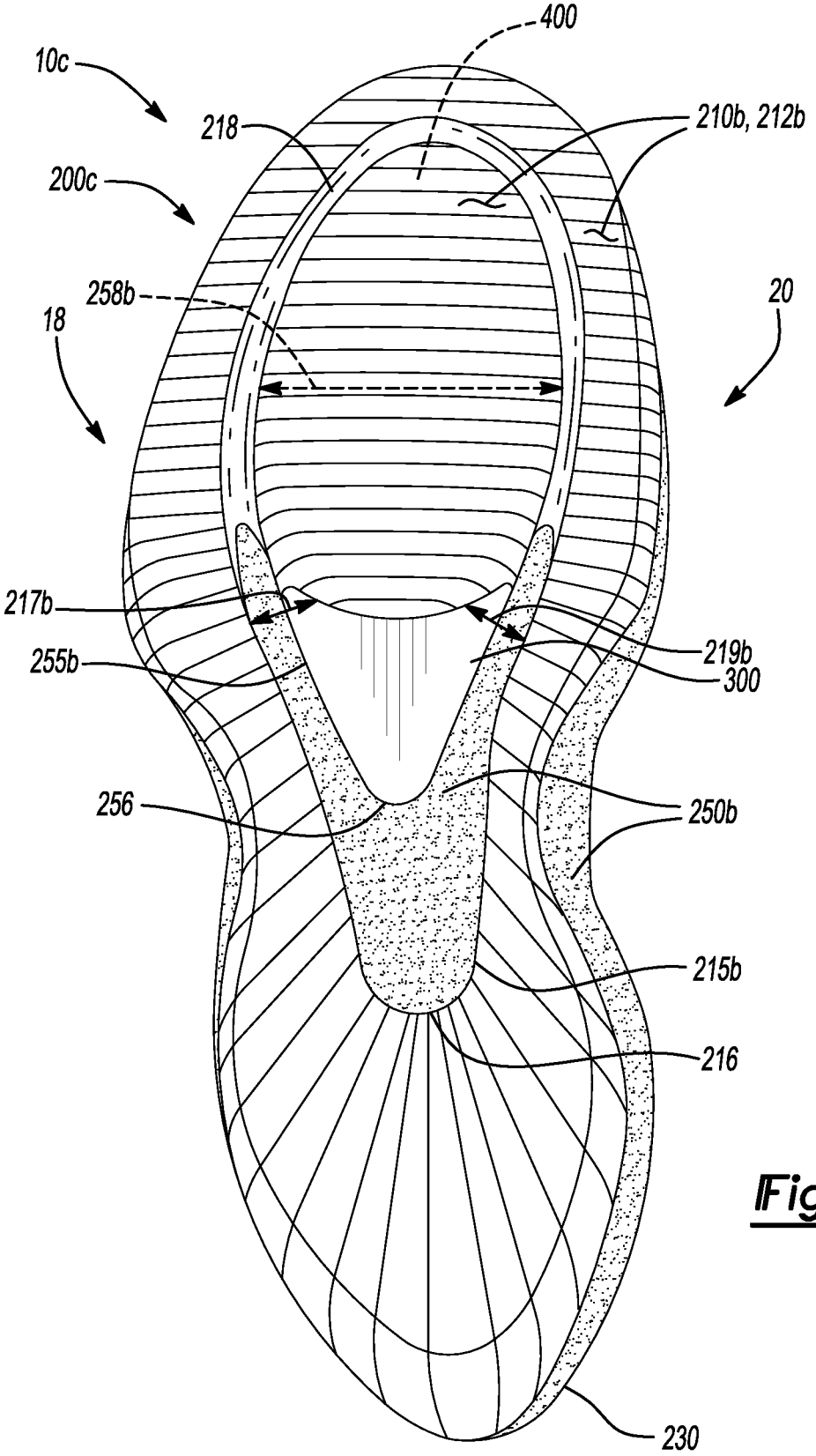
FIG. 16 is a bottom view of the article of footwear of FIG. 13 showing an outsole and a cushioning member each defining apertures that align with one another to expose a footwear plate disposed on the cushioning member.

With reference to FIGS. 15 and 16, the aperture 255*b* associated with the portion of the cut-out region 255*b* unoccupied by the fluid-filled bladder 400*c* may overlap with the portion of the aperture 215*b* formed through the outsole 210*b* to provide the region 415 where the plate 300 is exposed relative to the view from the bottom of the footwear 10*c*. As the apex point 216 for the aperture 215*b* formed through the outsole 210*a* is offset relative to the apex point 256 of the aperture 255*b* within the cut-out region 258*b* of the cushioning member 250*b*, portions of the aperture 215*b* formed through the outsole 210*b* may expose portions of the cushioning member 250*b* that are obstructing the footwear plate 300 relative to the view from the bottom of the footwear 10*b*. For instance, the tapering sidewall 253*b* extending between the top surface 254*b* and the bottom surface 252*b* of the cushioning member 250*b* effectively obstructs the footwear plate 300 from view, while the aperture 215*b* formed through the outsole 210*b* may expose at least a portion of the tapering sidewall 253*b*.

FIG. 16 provides a bottom view of the article of footwear 10*c* of FIG. 13 showing the footwear plate 300 exposed/visible in the regions where the aperture 215*b* formed through the outsole 210*b* overlaps with the aperture 255*b* within the cut-out region 258*b* of the cushioning member 250*b*. The outsole 210*b* includes the lateral segment 217*b* and the medial segment 219*b* extending from the apex point 216 that may be narrower than corresponding ones of the lateral segment 217 and the medial segment 219 of the aperture 215 formed through the outsole 210 of FIGS. 1-4. Additionally, the distance the lateral segment 217*b* extends into the forefoot portion 12 of the outsole 210*b* from the apex 216 may the same as the distance the lateral segment 217*a* extends into the forefoot portion 12 of the outsole 210*a* of FIGS. 5-8, and the distance the medial segment 219*b* extends into the forefoot portion 12 of the outsole 210*b* from the apex 216 may be the same as the distance the medial segment 219*b* extends into the forefoot portion 12 of the outsole 210*a* of FIGS. 5-8.

In some implementations, the outsole 210*b* defines the semi-elliptical groove 218 within the forefoot portion 12 that extends from the terminal ends of the lateral and medial segments 217*b*, 219*b*, respectively, of the aperture 215*b* to surround the interior region of the outsole 210 that obstructs the fluid-filled bladder 400*c* received within the cut-out region 258*b* formed through the cushioning member 250*b*. The semi-elliptical groove 218 may impart flexibility to the outsole 210*b* to allow the fluid-filled bladder 400*c* received by the cut-out region 258*b* of the cushioning member 250*b*, as well as portions of the cushioning member 250*b* surrounding the cut-out region 258*b*, to compress and thereby provide cushioning for the foot at the point of application of the push-off force from the ground surface. While the cushioning member 250*b* provides cushioning for the foot as the foot flexes through dorsiflexion, the longitudinal stiffness of the footwear plate 300 simultaneously provides an energy return to propel the foot forward and, thus, attain longer jumping distances compared to that of footwear that does not incorporate a footwear plate, or footwear incorporating a footwear plate with more extreme parabolic geometry.

Figure 17:
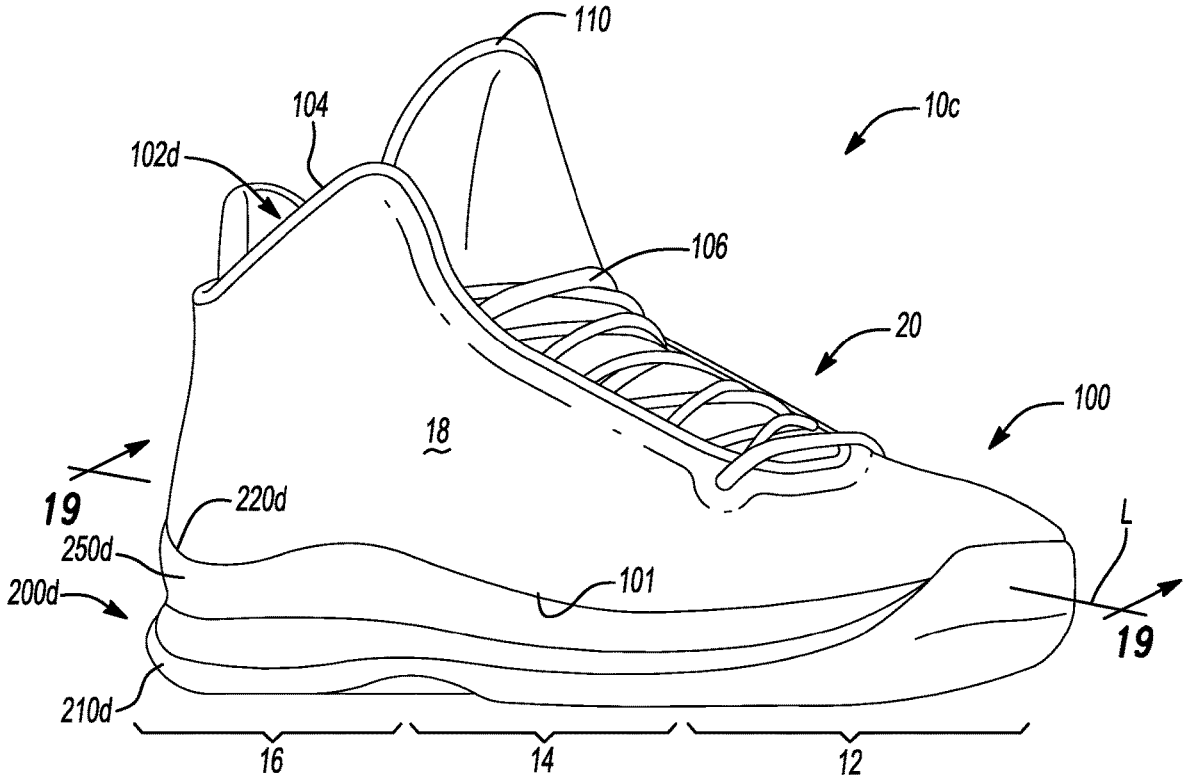
FIG. 17 is a top perspective view of an article of footwear in accordance with principles of the present disclosure.
Figure 18:
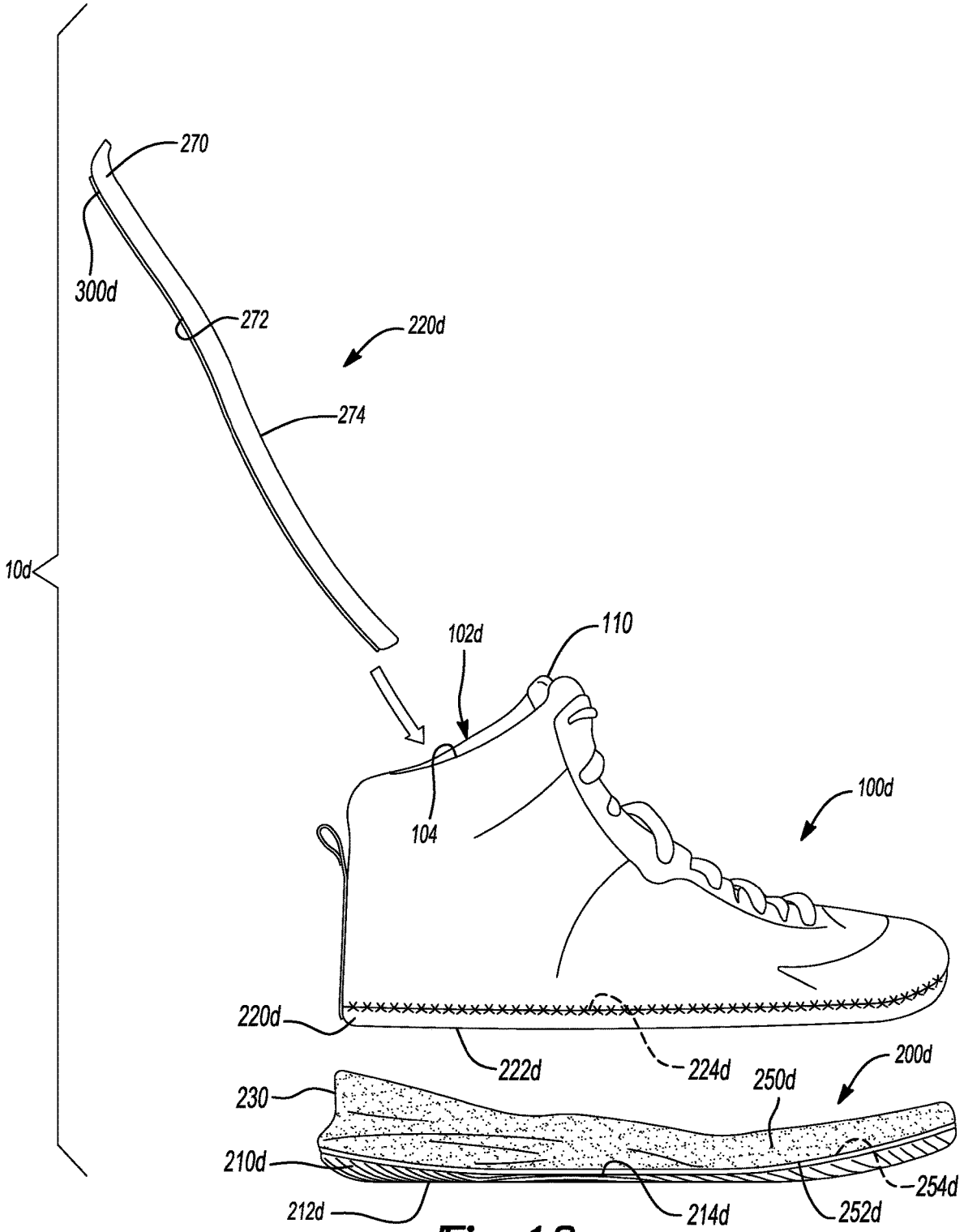
FIG. 18 is an exploded view of the article of footwear of FIG. 17 showing a drop-in midsole and footwear plate inserted into an interior void defined by an upper.
Figure 19:
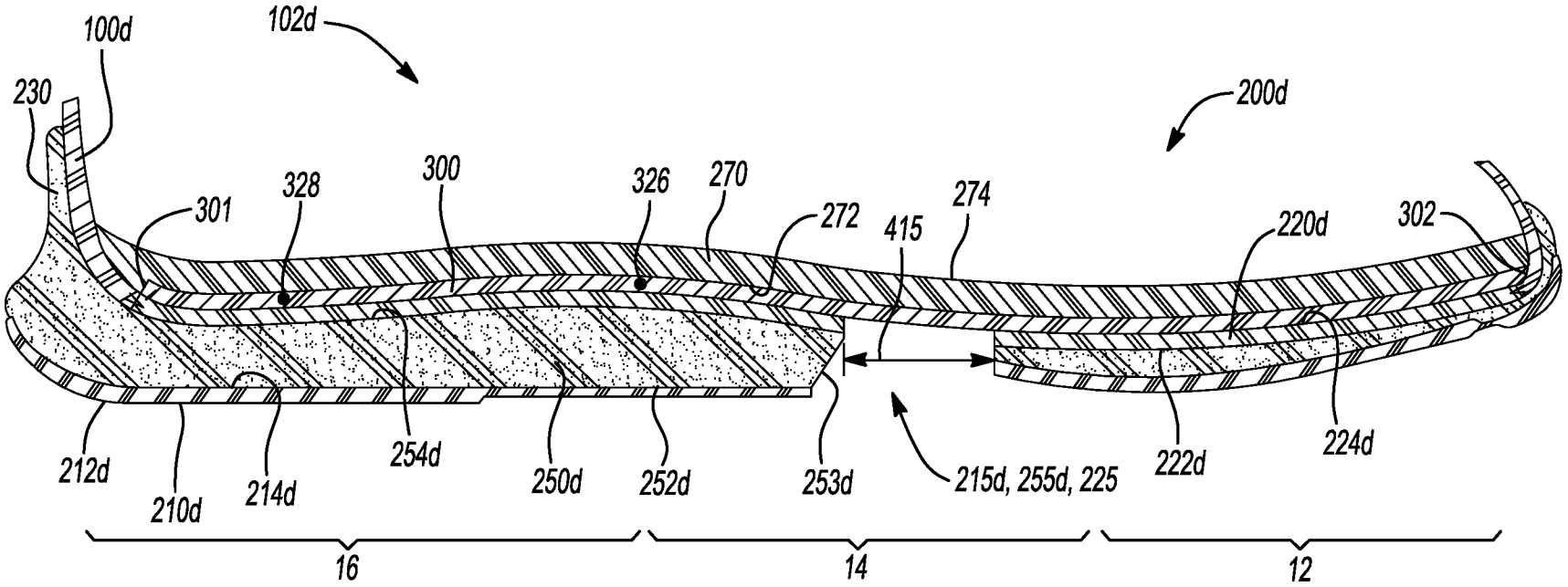
FIG. 19 is a cross-sectional view taken along line 19-19 of FIG. 17 showing a footwear plate disposed between a drop-in midsole and a strobel within an interior void defined by an upper.

Referring to FIGS. 17-19, in some implementations, an article of footwear 10*d* includes an upper 100*d*, a cushioning member 250*d* attached to the upper 100*d*, an outsole 210*d* attached to the cushioning member 250*d*, a midsole 270, and a footwear plate 300*d* operable to increase a resultant impulse of the footwear 10*d* when applying a push-off force from the ground surface to propel the foot further, and thereby attain longer horizontal jumping distances. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

The upper 100*d* may be formed from the flexible material forming the upper 100 of FIGS. 1-16 to form an interior void 102*d* accessible by the ankle opening 104 in the heel portion 16 of the upper 100*d*. The upper 100*d* further includes a strobel 220*d* extending around the perimeter of the upper 100*d* and having an interior surface 224*d* opposing the upper 100*f* and an outer surface 222*d* opposing the outsole 210*d*. FIG. 18 provides an exploded view of the footwear 10*d* of FIG. 17 showing the plate 300*d* received by the interior void 102*d* upon the interior surface 224*d* of the strobel 220*d* and the midsole 270 corresponding to a drop-in midsole received by the interior void 102*d* upon the plate 300*d*, while the cushioning member 250*d* attaches to the outer surface 222*d* of the strobel 220*d* and/or to exterior surfaces around the periphery of the upper 100*d* (e.g., at the bottom edge 101). The outsole 210*d* includes a ground-engaging surface 212*d* and an inner surface 214*d* disposed on the opposite side of the outsole 210*d* than the ground-engaging surface 212*d* and opposing the cushioning member 250*d*. The cushioning member 250*d* is disposed between the outsole 210*d* and the strobel 220*d* and includes a bottom surface 252*d* opposing the inner surface 214*d* of the outsole 210*d* and a top surface 254*d* disposed on an opposite side of the cushioning member 250*d* than the bottom surface 252*d* and opposing the outer surface 222*d* of the strobel 220*d*. On the other hand, the midsole 270 includes a bottom surface 272 received by the plate 300*d* within the interior void 102*d* and a footbed 274 disposed on an opposite side of the midsole 270 than the bottom surface 272. In some examples, an insole or sock-liner is disposed upon the footbed 274 and configured to receive the bottom surface of a foot. Accordingly, the outsole 210*d*, the cushioning member 250*d*, the strobel 220*d*, the plate 300*d*, and the midsole 270 are arranged in a layered configuration with the midsole 270 and footwear plate 300*d* disposed within the interior void 102*f* of the upper 100*f* upon the strobel 220*d*. In other configurations, the strobel 220*d* is omitted and the cushioning member 250*d* and/or outsole 210*d* attach directly to upper 100*d* such that the top surface 252*d* of the cushioning member 250*d* and interior surfaces of the upper 100*d* define the interior void 102*d*. In these configurations, the top surface 252*d* of the cushioning member 250*d* receives the plate 300*d* thereon.

FIG. 19 provides a cross-sectional view taken along line 19-19 of FIG. 17 showing the footwear plate 300*d* received by the interior void 102*d* of the upper 100*d* between the strobel 220*d* and the midsole 270 and the cushioning member 250*d* disposed between the outsole 210*d* and the strobel 220*d*. The footbed 274 of the midsole 270 may define a surface profile contoured to the profile of the bottom surface (e.g., plantar) of the foot received within the interior void 102*d*, while the bottom surface 272 of the midsole 270 may define a surface profile contoured to the surface profile of the plate 300*d* underneath. The plate 300*d* may define a curvature contoured to the curvature of the strobel 220*d* and/or the bottom edge 101 of the upper 100*d*.

The midsole 270 may compress resiliently under applied loads to prevent the foot from translating into contact with the plate 300 while additionally providing a level of soft-type cushioning for the foot to attenuate ground-reaction forces and enhance comfort for the wearer's foot. In some configurations, the midsole 270 corresponds to a slab of polymer foam formed from any suitable materials that compress resiliently under applied loads. Examples of suitable polymer materials for the foam materials include ethylene vinyl acetate (EVA) copolymers, polyurethanes, polyethers, and olefin block copolymers. The foam can also include a single polymeric material or a blend of two or more polymeric materials including a polyether block amide (PEBA) copolymer, the EVA copolymer, a thermoplastic polyurethane (TPU), and/or the olefin block copolymer.

The footwear plate 300*d* is substantially identical to the footwear plate 300 of FIGS. 1-16 except that the footwear plate 300*d* is received by the interior void 102*d* on an opposite side of the strobel 220*d* than the cushioning member 250*d*. Accordingly, the plate 300*d* defines the length extending between the first end 301 (e.g., PMP 301) and the second end 302 (e.g., AMP 302) that may be the same as or less than the length of the midsole 270 and/or cushioning member 250*d*. In other examples, the plate 300*d* omits the posterior curved region 312 and only includes the anterior curved region 310 to define a length from the aft point 326 to the AMP 302 that extends through the forefoot and mid-foot portions 12, 14, respectively, of the sole structure 200*d*. The footwear plate 300*d* includes the anterior curved region 310 extending through the forefoot portion 12 and the mid-foot portion 14 of the sole structure 200*d*, and may optionally include the posterior curved region 312 through the heel portion 16 from the anterior curved region 310 to the PMP 301 of the plate 300*d*. The anterior curved region 310 is associated with the radius of curvature about the MTP point 320 to define the forefoot curved portion 322 extending between the MTP point 320 and the AMP 302 of the plate 300*d*, and the mid-foot curved portion 324 extending between the MTP point 320 and the aft point 326 disposed at the junction of the anterior curved region 310 and the posterior curved region 312. The curved portions 322, 324 may each include a corresponding radius of curvature that may be the same or may be different from one another. The posterior curved region 312 is associated with the radius of curvature about the calcaneus point 328, or in other configurations, the region 312 may be substantially flat. The anterior curved region 310, and the optional posterior curved region 312, provides the plate 300*d* with a longitudinal stiffness that reduces energy loss as the foot flexes through dorsiflexion such that a resultant impulse increases when the foot pushes off of the ground surface to thereby increase a horizontal jumping distance by the foot during athletic movements.

As with the footwear plate 300 described above with reference to FIGS. 1-16, the footwear plate 300*d* may include the uniform local stiffness that may or may not be anisotropic. For instance, the plate 300*d* may be formed from the one or more layers/plies of unidirectional tape including at least one of carbon fibers, aramid fibers, boron fibers, glass fibers, and polymer fibers. The plate 300*d* may define a substantially uniform thickness ranging from about 0.6 mm to about 3.0 mm. In one example, the thickness of the plate 300*d* is substantially equal to 1.2 mm. The stiffness and geometry of the plate 300*d* may be selected for increasing the resultant impulse at the point of application providing the push-off force from the ground surface to thereby enhance propulsion and increase the horizontal jump distance of the footwear 10*d*.

As with the cushioning member 250 of FIGS. 1-4, the cushioning member 250*d* may define the sidewall 230 surrounding at least a portion of a perimeter of the cushioning member 250*d*. The sidewall 230 may define the rim that extends around the perimeter of the strobel 220*d* and/or exterior surfaces of the upper 100*d* when the cushioning member 250*d* attaches to the strobel 220*d* and/or the upper 100*d*. The cushioning member 250*d* may compress resiliently between the strobel 220*d* and the outsole 210*d*. The cushioning member 250*d* may be formed from the slab of polymer foam which may be formed from the same one or more materials forming the cushioning member 250 of FIGS. 1-4. For instance, the cushioning member 250*d* may be formed from one or more of EVA copolymers, polyurethanes, polyethers, olefin block copolymers, PEBA copolymers, and/or TPUs. The cushioning member 250*d* and the midsole 270 may cooperate to impart different types of cushioning characteristics. For instance, the cushioning member 250*d* may compress resiliently under applied loads, while the midsole 270 provides the level of soft-type cushioning for the foot to attenuate ground-reaction forces and enhance comfort for the wearer's foot.

With continued reference to FIG. 19, the cushioning member 250*d* defines an aperture 255*d* formed through the bottom and top surfaces 252*d*, 254*d* within the forefoot and/or mid-foot portions 12, 14 of the cushioning member 250*d*. The aperture 255*d* may correspond to any one of the v-shaped or arrowhead-shaped apertures 255, 255*a*, 255*b* of FIGS. 1-16. The apex point 256 may be disposed within the mid-foot portion 14 between the lateral side 18 and the medial side 20. For instance, a distance between the apex point 256 and the lateral side 18 of the cushioning member 250*d* may be substantially equal to a distance between the apex point 256 and the medial side 20 of the cushioning member 250*d*. Moreover, a sidewall 253*d* defining the aperture 255*d* may taper from the top surface 254*d* to the bottom surface 252*d* of the cushioning member 250*d*. For instance, the sidewall 253*d* may taper from the top surface 254*d* in a direction away from interior regions and the forefoot portion 12 of the cushioning member 250*d* and toward the bottom surface 252*d* thereof.

The outsole 210*d* also defines a corresponding aperture 215*d* formed through the ground-engaging and inner surfaces 212*d*, 214*d* within the forefoot and/or mid-foot portions 12, 14 of the outsole 210*d*. The aperture 215*d* may correspond to any one of the apertures 215, 215*a*, 215*b* of FIGS. 1-16. The apex point 216 may be disposed within the mid-foot portion 14 of the outsole 210*d* between the lateral side 18 and the medial side 20. For example, a distance between the apex point 216 and the lateral side 18 of the outsole 210*d* may be substantially equal to a distance between the apex point 216 and the medial side 20 of the outsole 210*d*. In some examples, the apex point 216 for the aperture 215*d* formed through the outsole 210*d* is disposed closer to the heel portion 16 than the apex point 256 for the aperture 255*d* formed through the cushioning member 250*d*.

Moreover, the strobel 220*d* defines a corresponding aperture 225 formed through the outer and inner surfaces 222*d*, 224*d* within the forefoot and/or mid-foot portions 12, 14 of the outsole 210*d*. The aperture 225*d* may define a shape that corresponds to the shapes of the apertures 215*d*, 255*d* formed through corresponding ones of the outsole 210*d* and cushioning member 250*d*. Overlapping portions of the apertures 215*d*, 225, 255*d* formed through the outsole 210*d*, the strobel 220*d*, and the cushioning member 250*d*, respectively, cooperate to provide the region 415 where the plate 300*d* is exposed relative to a view from the bottom of the footwear 10*d*. Thus, the footwear plate 300*d* disposed within the interior void 102*d* of the upper 100*d* is exposed, or otherwise visible relative to the view from the bottom of the footwear 10*d*, in the region 415 where the aperture 215*d* formed through the outsole 210*d* aligns (e.g., in a direction substantially perpendicular to the longitudinal axis L) with both of the apertures 225, 255*d* formed through corresponding ones of the strobel 220*d* and the cushioning member 250*d*. A terminal edge of the outsole 210*d* that defines the aperture 215*d* formed therethrough may terminate adjacent to the bottom surface 252*d* of the cushioning member 250*d* such that the terminal edge of the outsole 210*d* is spaced apart from the strobel 220*d* by a distance substantially equal to a thickness of the of the cushioning member 250*d*. Moreover, portions of the aperture 215*d* formed through the outsole 210*d* that do not align with the aperture 255*d* formed through the cushioning member 250*d* may expose the cushioning member 250 while the cushioning member 250*d* obstructs the strobel 220*d* and the plate 300*d*. For example, the tapering sidewall 253*d* extending between the top surface 254*d* and the bottom surface 252*d* of the cushioning member 250*d* may obstruct the strobel 220*d* and the footwear plate 300 from view, while the aperture 215*d* formed through the outsole 210*d* may expose the tapering sidewall 253*d*. In some configurations, the strobel 220*d* is omitted such that the plate 300*d* rests directly upon the top surface 252*d* of the cushioning member 250*d* and is visible in the region 415 where the apertures 215*d*, 255*d* overlap.

Figure 20:
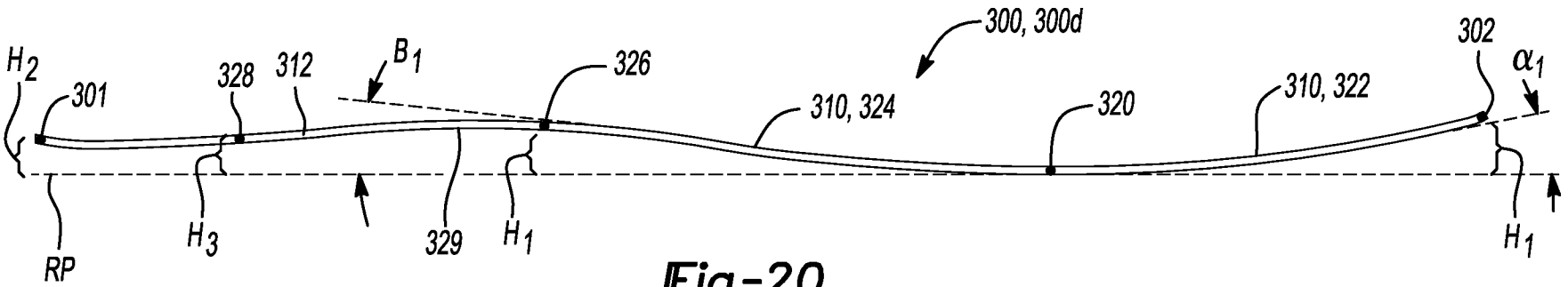
FIG. 20 is a side view of the footwear plate of FIGS. 1-19.

FIG. 20 provides a side view of the footwear plate 300, 300*d* that may be incorporated into any one of the articles of footwear 10-10*d* of FIGS. 1-19. The MTP point 320 is shown as a closest point of the footwear plate 300 to a horizontal reference plane RP extending substantially parallel to a ground surface (not shown). For instance, the MTP point 320 is tangent to the horizontal reference plane RP and may be disposed directly beneath the MTP joint of the foot when the foot is received by the interior void 102, 102*d* of the footwear 10-10*d*. In other configurations, the MTP point 320 is disposed beneath and slightly behind the MTP joint of the foot such that forefoot curved portion 322 is underneath the MPT joint of the foot. The forefoot curved portion 322 of the anterior curved region 310 may define a corresponding radius of curvature and a corresponding horizontal length between the MTP point 320 and the AMP 302, while the mid-foot curved portion 324 of the anterior curved region 310 may define a corresponding radius of curvature and a corresponding horizontal length between the MTP point 320 and the aft point 326. As used herein, the horizontal lengths are each measured along the horizontal reference plane RP between the MTP point 320 and respective ones of the AMP 302 and the aft point 326. In some examples, the forefoot curved portion 322 accounts for approximately thirty percent (30%) of the length of the sole structure 200-200*d*, the mid-foot curved portion 324 accounts for approximately thirty percent (30%) of the length of the sole structure 200-200*d*, and the posterior curved region 312 accounts for approximately forty percent (40%) of the length of the sole structure 200-200*d*. In other examples, the forefoot curved portion 322 is within the range from about twenty-five percent (25%) to about thirty-five percent (35%) of the length of the sole structure 200-200*d*, the mid-foot curved portion 324 is within the range from about twenty-five percent (25%) to about thirty-five percent (35%) of the length of the sole structure 200-200*d*, and the posterior curved region 312 includes the remainder of the length of the sole structure 200-200*d*. In some configurations, the plate 300 omits the posterior curved region 312 such that the aft point 326 is associated with the posterior-most point of the plate to define an overall length extending between the aft point 326 and the AMP 302.

In some implementations, the AMP 302 and the aft point 326 are located above the MTP point 320 by a distance substantially equal to first position height $H_1$, the PMP 301 is located above the MTP point 320 by a distance substantially equal to second position height $H_2$, and the calcaneus point 328 is located above the MTP point 320 by a distance substantially equal to third position height $H_3$. Each of the heights $H_1$, $H_2$, $H_3$ extend from the MTP point 320 in a direction substantially perpendicular to the longitudinal axis L of the sole structure 200. In some configurations, the first height $H_1$ is greater than the second height $H_2$ and the second height $H_2$ is greater than the third height $H_3$. Thus, the toes of the foot residing above the forefoot curved portion 322 may be biased upward due to the forefoot curved portion 322 extending away from the outsole 210 from the MTP point 320 and toward the AMP 302. Moreover, the heel (e.g., calcaneus bone) of the foot may reside above the MTP joint of the foot due to the calcaneus point 328 disposed further away from the outsole 210 than the MTP point 320 such that the resultant impulse provided by the plate 300 when the foot pushes off of the ground surface increases propulsion by the foot in the forward direction to thereby provide longer jumping distances.

The radius of curvature associated with the forefoot curved portion 322 results in the AMP 302 extending from the MTP point 320 at an angle α1 relative to the horizontal reference plane RP. Accordingly, the forefoot curved portion 322 allows the plate 300 to bias the toes of the foot in a direction away from the ground surface. The angle α1 may include a value within a range from about 12-degrees to about 35-degrees. In one example, angle α1 includes a value less than 24-degrees. Similarly, the radius of curvature associated with the mid-foot curved portion 324 results in the aft point 326 extending from the MTP point 320 at an angle β1 relative to the horizontal reference plane RP. The angle β1 may include a value within a range from about 12-degrees to about 35-degrees. In one example, angle β1 includes a value less than 24-degrees. In some configurations, angles α1 and β1 are substantially equal to one another such that the radii of curvature of the forefoot and mid-foot curved portions 322, 326 are equal to one another and share the same vertex. In these configurations, the anterior curved region 310 follows a constant radius of curvature extending through the MTP point 320 from the AMP 302 to the aft point 326.

In some implementations, the aft point 326 is disposed along a blend portion 329 along the anterior curved region 310 of the plate 300 that includes a radius of curvature configured to join the anterior curved region 310 at the mid-foot curved portion 324 to the posterior curved region 312. Thus, the blend portion 329 is disposed between and connecting the constant radius of curvature of the anterior curved region 310 to the posterior curved region 312. In some examples, the blend portion 329 includes a substantially constant radius of curvature. The blend portion 329 may allow the posterior curved region 312 of the plate to extend through the calcaneus point 328 from the first end 301 (PMP 301) to the aft point 326. As a result of the radius of curvature of the posterior curved portion 324 and the radius of curvature of the blend portion 328, the aft point 326 may include a position height $H_1$ above the MTP point 320. As used herein, the position height $H_1$ of the aft point 326 corresponds to a separation distance extending in a direction substantially perpendicular to the horizontal reference plane RP between the aft point 326 and the reference plane RP. The position height $H_1$ may include a value within the range from about 3 mm to about 28 mm in some examples, while in other examples the position height $H_1$ may include a value within the range from about 3 mm to about 17 mm. In one example, the position height $H_1$ includes a value less than 17 mm. In some implementations, the PMP 301 and the AMP 302 are co-planer at a junction of the blend portion 329 and the posterior curved region 312

Figure 21:
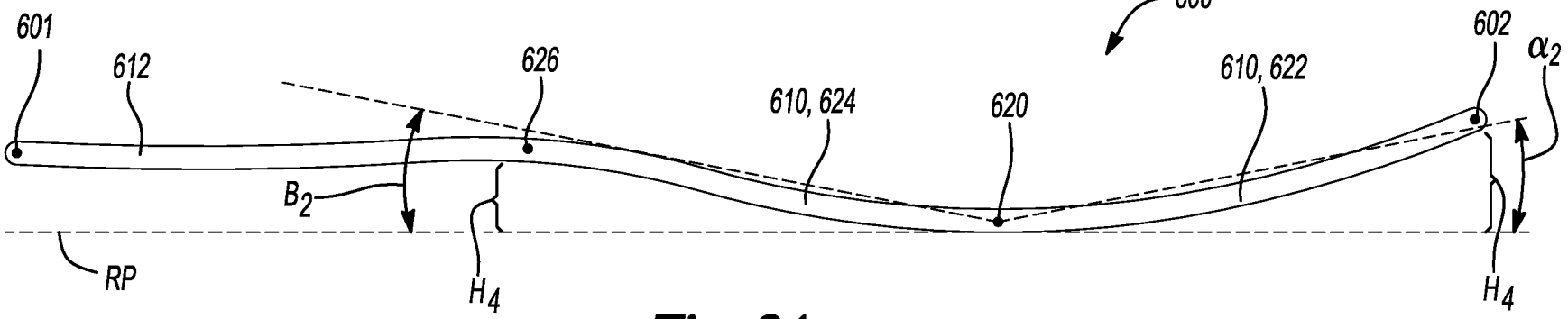
FIG. 21 is a side view of a parabolic footwear plate in accordance with principles of the present disclosure.

FIG. 21 provides a side view of a parabolic plate 600 having an anterior curved region 610 associated with a smaller radius of curvature than the radius of curvature associated with the anterior curved region 310 of the footwear plate 300, 300*d* of FIG. 20. Further details of the parabolic plate 600 may be described in U.S. application Ser. No. 15/248,059, filed Aug. 26, 2016, which is hereby incorporated by reference in its entirety. The anterior curved region 610 may extend through the forefoot portion and the mid-foot portion of an example sole structure, while an optional substantially flat region 612 may extend through a heel portion of the example sole structure from the anterior curved region 610 to a posterior-most point 601 of the plate 600.

The curved region 610 includes the radius of curvature about an MTP point 620 to define a forefoot curved portion 622 extending from one side of the MTP point 620 and a mid-foot curved portion 624 extending from the other side of the MTP point 620. For instance, the anterior curved portion 622 extends between the MTP point 620 and an anterior-most point (AMP) 602 of the plate 600, while the mid-foot curved portion 624 extends between the MTP point 620 and an aft point 626 disposed at a junction of the anterior curved region 610 and the flat region 612. In some examples, the forefoot curved portion 622 and the mid-foot curved portion 624 are associated with the same radius of curvature that is mirrored about the MTP point 620. In other examples, the forefoot curved portion 622 and the mid-foot curved portion 624 are each associated with a different radius of curvature. Accordingly, the curved portions 622, 624 may each include a corresponding radius of curvature that may be the same or may be different from one another. In some examples, the radius of curvatures differ from one another by at least two percent (2%). The radius of curvatures for the curved portions 622, 624 may range from 200 millimeters (mm) to about 400 mm. Additionally or alternatively, the plate may define a blend region 629 having a radius of curvature that connects the mid-foot curved portion 624 to the substantially flat region 612 of the plate 600. As used herein, the term "substantially flat" refers to the flat region 612 within five (5) degrees horizontal, i.e., within five (5) parallel to the ground surface.

As a result of the radius of curvatures for the curved portions 622, 624, the aft point 626 and the AMP 602 may include a position height $H_4$ above the MTP point 620. The position height $H_4$ is greater than the position height $H_1$ of the aft point 326 and the AMP 302 above the MTP point 320 of the plate 300, 300*d* of FIG. 20. As used herein, the position height $H_4$ of the aft point 626 and the AMP 602 corresponds to a separation distance extending in a direction substantially perpendicular to the horizontal reference plane RP between the aft point 626 and the reference plane RP. The position height $H_4$ may include a value within the range from about 3 mm to about 28 mm in some examples, while in other examples the position height $H_4$ may include a value within the range from about 3 mm to about 17 mm. In one example, the position height $H_4$ includes a value equal to 17 mm and greater than the position height $H_1$ of FIG. 20. In some implementations, the PMP 301 and the AMP 302 are co-planer at a junction of the blend portion 329 and the posterior curved region 312

FIG. 21 shows the MTP point 620 of the anterior curved region 610 tangent to the horizontal reference plane RP. The radius of curvature of the forefoot curved portion 622 extending between the MTP point 620 and the AMP 602 is smaller than the radius of curvature of the forefoot curved portion 322 of the plate 300, 300*d* of FIG. 20. Thus, the radius of curvature associated with the forefoot curved portion 622 results in the AMP 602 extending from the MTP point 620 at an angle α2 relative to the horizontal reference plane RP that is greater than the angle α1 associated with the forefoot curved portion 322 of the plate 300, 300*d* of FIG. 20. Accordingly, the forefoot curved portion 622 is associated with a steeper slope than that of the forefoot curved portion 322 of the plate 300, 300*d* of FIG. 20 such that plate 600 biases toes of the foot further away from the ground surface compared to the plate 300, 300*d* of FIG. 20.

Similarly, the mid-foot curved portion 624 extending between the MTP point 620 and the aft point 626 includes a radius of curvature that is smaller than the radius of curvature of the mid-foot curved portion 324 of the plate 300, 300*d* of FIG. 20. Thus, the radius of curvature associated with the mid-foot curved portion 624 results in the aft point 626 extending from the MTP point 620 at an angle β2 relative to the horizontal reference plane RP that is greater than the angle β1 associated with the mid-foot curved portion 324 of the plate 300, 300*d* of FIG. 20. Accordingly, the mid-foot curved portion 624 is associated with a steeper slope than that of the mid-foot curved portion 324 of the plate 300, 300*d* of FIG. 20 such that the parabolic plate 600 biases the MTP joint of the foot toward the ground surface further away from the heel of the foot compared to the plate 300, 300*d* of FIG. 20. The angle α2 may include a value within a range from about 12-degrees to about 35-degrees. In one example, angle α2 includes a value approximately equal to 24-degrees. The angle β2 may include a value within a range from about 12-degrees to about 35-degrees. In one example, angle $\beta_2$ includes a value approximately equal to 24-degrees. In some configurations, angles α2 and β2 are substantially equal to one another such that the radii of curvature are equal to one another and share the same vertex.

In view of the foregoing, the curved portions 322, 324 of the plate 300, 300*d* of FIGS. 1-20 each define slopes extending in opposite directions from the MTP point 320 that are more gradual than the slopes defined by corresponding ones of the curved portions 622, 624 of the plate 600 of FIG. 21. While the anterior curved region 310 for the plate 300, 300*d* of FIGS. 1-20 and the anterior curved region 610 for the plate 600 of FIG. 21 are each operative to provide the plates 300, 300*d*, 600 with a corresponding longitudinal stiffness that reduces energy loss proximate to the MTP joint of the foot, the more gradual sloping associated with the curved portions 322, 324 of the plate 300, 300*d* of FIGS. 1-20 is operative to increase the resultant impulse provided by the plate 300, 300*d* when the foot pushes off of the ground surface, and thereby increase propulsion by the foot in the forward direction to attain longer horizontal jumping distances. By contrast, the steeper slopes associated with the curved portions 622, 624 of the plate 600 of FIG. 21 decrease the resultant impulse and, thus, results the plate 600 attaining shorter horizontal jumping distances than those attained by the plate 300, 300*d* of FIGS. 1-20. Accordingly, the steeper slopes associated with the curved portions 622, 624 of the plate 600 of FIG. 21 are best suited for enhancing rolling of the foot during running motions to thereby reduce a lever arm distance and alleviate strain on the ankle joint.

Figure 22:
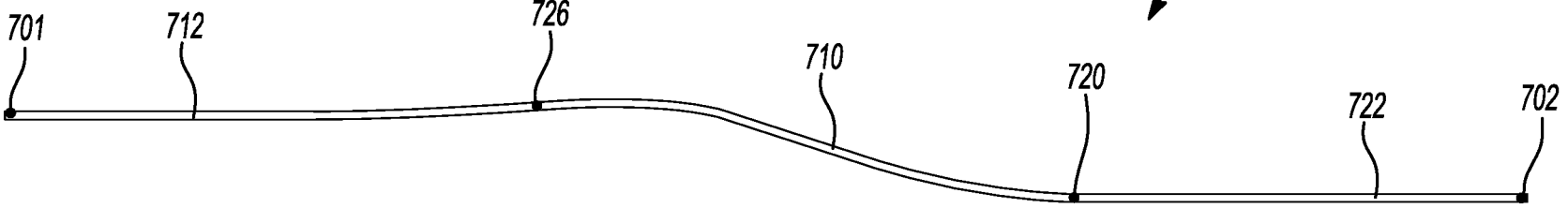
FIG. 22 is a side view of a lever footwear plate in accordance with principles of the present disclosure.

FIG. 22 provides a side view of a lever plate 700 having a curved region 710 bridging a first substantially region 712 and a second substantially flat region 722. The first substantially flat region 712 may extend from a posterior-most point 701 of the plate 700 to an aft point 726 and the curved region 710 may extend from the aft point 726 to an MTP point 720 associated with the lowest point of the plate 700. The MTP point 720 is disposed approximately beneath the MTP joint of the foot. The second substantially flat region 722 extends from the MTP point 720 to an anterior-most point 702 of the plate 700. Accordingly, the lever plate 700 is operative to bias the heel of the foot above the MTP joint, while providing little to no biasing of the toes of the foot due to the plate 700 not sloping relative to the ground surface along the second substantially flat region 722. As the lever plate 700 is substantially rigid to increase an overall stiffness of the sole structure, and thereby reduce energy loss at the MTP joint by preventing the MTP joint from absorbing energy through dorsiflexion, the flat profile along the second substantially flat region 722 is operative to provide a resultant impulse when the foot pushes off of the ground surface that is less than the resultant impulse provided by the anterior curved region 310 of the plate 300, 300*d* of FIGS. 1-20. Accordingly, the lever plate 700 provides shorter horizontal jumping distances compared to the jumping distances provided by the plate 300, 300*d* of FIGS. 1-20.

The following Clauses provide an exemplary configuration for a sole structure for an article of footwear and methods for manufacturing an article of footwear.

Clause 1: A sole structure for an article of footwear having an upper, the sole structure comprising an outsole defining a first aperture, and a cushioning member disposed on the outsole and defining a second aperture. A plate may be disposed between the cushioning member and the upper, the plate comprising an anterior-most point disposed in a forefoot region of the sole structure, a posterior-most point disposed closer to a heel region of the sole structure than the anterior-most point, a metatarsophalangeal (MTP) point disposed between the anterior-most point and the posterior-most point, the MTP point opposing an MTP joint of a foot during use, and an anterior curved region having a radius of curvature extending through the forefoot region and a mid-foot region of the sole structure and including a forefoot curved portion extending from the MTP point to the anterior-most point and a mid-foot curved portion extending from the MTP point toward the posterior-most point, wherein overlapping portions of the first aperture and the second aperture expose a region of the plate.

Clause 2: The sole structure of Clause 1, wherein the anterior-most point and the posterior-most point are co-planar.

Clause 3: The sole structure of Clause 1, wherein the plate includes a posterior curved region disposed within the heel region of the sole structure, the posterior-most point being located within the posterior curved region.

Clause 4: The sole structure of Clause 3, wherein the mid-foot curved portion extends from the MTP point to an aft point disposed within the mid-foot region of the sole structure between the MTP point and the posterior-most point.

Clause 5: The sole structure of Clause 4, wherein the aft point and the anterior-most point are co-planer.

Clause 6: The sole structure of Clause 5, wherein a planar extent of the posterior-most point is offset relative to the planar extent of the aft point and the anterior-most point.

Clause 7: The sole structure of any of Clauses 3-6, further comprising a blend portion disposed between and connecting the anterior curved region and the posterior curved region.

Clause 8: The sole structure of Clause 7, wherein the blend portion includes a substantially constant curvature.

Clause 9: The sole structure of any of the preceding clauses, wherein the second aperture defined by the cushioning member includes an apex point disposed within the mid-foot region of the sole structure.

Clause 10: The sole structure of Clause 9, wherein the second aperture includes a lateral segment extending toward the forefoot region along a lateral side of the sole structure from the apex point and a medial segment extending toward the forefoot region along a medial side of the sole structure from the apex point.

Clause 11: The sole structure of Clause 10, wherein the lateral segment and the medial segment of the second aperture defined by the cushioning member define a peninsular region within the forefoot region of the sole structure.

Clause 12: The sole structure of any of Clauses 9-11, wherein the first aperture defined by the outsole includes an apex point disposed within the mid-foot region of the sole structure, a lateral segment extending toward the forefoot region along the lateral side of the sole structure from the apex point, and a medial segment extending toward the forefoot region along the medial side of the sole structure from the apex point.

Clause 13: The sole structure of Clause 12, wherein the apex point of the first aperture defined by the outsole is disposed closer to the heel region of the sole structure than the apex point of the second aperture defined by the cushioning member.

Clause 14: The sole structure of any of the preceding clauses, wherein portions of the first aperture defined by the outsole that do not overlap with the second aperture defined by the cushioning member are operative to expose the cushioning member.

Clause 15: The sole structure of any of the preceding clauses, further comprising a fluid-filled bladder disposed between the plate and the outsole.

Clause 16: The sole structure of Clause 15, wherein the fluid-filled bladder is disposed within a cut-out region formed through the cushioning member.

Clause 17: The sole structure of Clause 16, wherein a portion of the cut-out region unoccupied by the fluid-filled bladder defines the second aperture.

Clause 18: The sole structure of any of the preceding clauses, wherein the MTP point is located approximately thirty percent (30%) of the total length of the plate from the anterior-most point.

Clause 19: The sole structure of any of the preceding clauses, wherein a center of the radius of curvature of the anterior curved region is located at the MTP point.

Clause 20: The sole structure of any of the preceding clauses, further comprising a strobel attached to the upper to define an interior void.

Clause 21: The sole structure of Clause 20, wherein the plate is disposed on the strobel within the interior void.

Clause 22: The sole structure of Clause 21, wherein the plate is visible through an ankle opening defined by the upper in the heel region, the ankle opening configured to provide access to the interior void.

Clause 23: The sole structure of any of Clauses 20-22, further comprising a midsole received by the interior void of the upper and opposing the plate.

Clause 24: The sole structure of any of Clauses 20-23, wherein the strobel defines a third aperture that overlaps with the overlapping portions of the first aperture and the second aperture to expose the plate.

Clause 25: The sole structure of any of the preceding clauses, wherein the exposed region of the plate includes the anterior curved region.

Clause 26: A method of manufacturing an article of footwear, the method comprising attaching a strobel to an upper, the upper defining an interior void and an ankle opening providing access to the interior void, providing an outsole defining a first aperture, attaching a cushioning member to the outsole, the cushioning member defining a second aperture, positioning a plate between the cushioning member and the upper, the plate comprising an anterior-most point disposed in a forefoot region of the footwear, a posterior-most point disposed closer to a heel region of the footwear than the anterior-most point, a metatarsophalangeal (MTP) point disposed between the anterior-most point and the posterior-most point, the MTP point opposing an MTP joint of a foot during use, and an anterior curved region having a radius of curvature extending through the forefoot region and a mid-foot region of the footwear and including a forefoot curved portion extending from the MTP point to the anterior-most point and a mid-foot curved portion extending from the MTP point toward the posterior-most point, wherein overlapping portions of the first aperture and the second aperture expose a region of the plate.

Clause 27: The method of Clause 26, wherein the anterior-most point and the posterior-most point are co-planar.

Clause 28: The method of Clause 26, wherein the plate includes a posterior curved region disposed within the heel region of the footwear, the posterior-most point being located within the posterior curved region.

Clause 29: The method of Clause 28, wherein the mid-foot curved portion extends from the MTP point to an aft point disposed within the mid-foot region of the footwear between the MTP point and the posterior-most point.

Clause 30: The method of Clause 29, wherein the aft point and the anterior-most point are co-planer.

Clause 31: The method of Clause 30, wherein a planar extent of the posterior-most point is offset relative to the planar extent of the aft point and the anterior-most point Clause 32: The method of Clauses 3-6, wherein the plate further comprises a blend portion disposed between and connecting the anterior curved region and the posterior curved region.

Clause 33: The method of Clause 32, wherein the blend portion includes a substantially constant curvature.

Clause 34: The method of any of the preceding clauses, wherein the second aperture defined by the cushioning member includes an apex point disposed within the mid-foot region of the footwear.

Clause 35: The method of Clause 34, wherein the second aperture includes a lateral segment extending toward the forefoot region along a lateral side of the footwear from the apex point and a medial segment extending toward the forefoot region along a medial side of the footwear from the apex point.

Clause 36: The method of Clause 35, wherein the lateral segment and the medial segment of the second aperture defined by the cushioning member define a peninsular region within the forefoot region of the footwear.

Clause 37: The method of any of Clauses 34-36, wherein the first aperture defined by the outsole includes an apex point disposed within the mid-foot region of the footwear, a lateral segment extending toward the forefoot region along the lateral side of the footwear from the apex point, and a medial segment extending toward the forefoot region along the medial side of the footwear from the apex point.

Clause 38: The method of Clause 37, wherein the apex point of the first aperture defined by the outsole is disposed closer to the heel region of the footwear than the apex point of the second aperture defined by the cushioning member.

Clause 39: The method of any of the preceding clauses, wherein portions of the first aperture defined by the outsole that do not overlap with the second aperture defined by the cushioning member are operative to expose the cushioning member.

Clause 40: The method of any of the preceding clauses, further comprising positioning a fluid-filled bladder between the plate and the outsole.

Clause 41: The footwear of Clause 40, wherein positioning the fluid-filled bladder comprises positioning the fluid-filled bladder within a cut-out region formed through the cushioning member.

Clause 42: The method of Clause 41, wherein a portion of the cut-out region unoccupied by the fluid-filled bladder defines the second aperture.

Clause 43: The method of any of the preceding clauses, wherein the MTP point is located approximately thirty percent (30%) of the total length of the plate from the anterior-most point.

Clause 44: The method of any of the preceding clauses, wherein a center of the radius of curvature of the anterior curved region is located at the MTP point.

Clause 45: The method of any of the preceding clauses, wherein positioning the plate comprises positioning the plate on the cushioning member underneath the strobel Clause 46: The method of any of Clauses 26-44, wherein positioning the plate comprises positioning the plate on the strobel within the interior void.

Clause 47: The method of Clause 46, wherein the plate is visible through the ankle opening.

Clause 48: The method of any of Clauses 45-47, further comprising positioning a midsole on the plate within the interior void Clause 49: The method of any of Clauses 45-48, wherein the strobel defines a third aperture that overlaps with the overlapping portions of the first aperture and the second aperture to expose the plate.

Clause 50: The method of any of the preceding clauses, wherein the exposed region of the plate includes the anterior curved region.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

an outsole defining a first aperture;

a cushioning member disposed on the outsole and including a peninsular region, the cushioning member defining a second aperture including (i) an apex point disposed within a mid-foot region of the sole structure, (ii) a lateral segment extending along a lateral side of the sole structure from the apex point towards a forefoot region of the sole structure, along a lateral side of the peninsular region, and tapering in a direction toward an anterior end of the sole structure, and (iii) a medial segment extending along a medial side of the sole structure from the apex point towards the forefoot region, along a medial side of the peninsular region, and tapering in a direction toward the anterior end of the sole structure; and a plate disposed on an opposite side of the cushioning member than the outsole, wherein overlapping portions of the first aperture and the second aperture expose a region of the plate, the exposed region of the plate tapering in a direction toward the anterior end of the sole structure.

2. The sole structure of claim 1, wherein the plate comprises:

an anterior-most point disposed in a forefoot region of the sole structure;

a posterior-most point disposed closer to a heel region of the sole structure than the anterior-most point and co-planar with the anterior-most point;

a metatarsophalangeal (MTP) point disposed between the anterior-most point and the posterior-most point, the MTP point opposing an MTP joint of a foot during use; and an anterior curved region having a radius of curvature extending through the forefoot region and a mid-foot region of the sole structure and including a forefoot curved portion extending from the MTP point to the anterior-most point and a mid-foot curved portion extending from the MTP point toward the posterior-most point.

3. The sole structure of claim 2, wherein the plate includes a posterior curved region disposed within the heel region of the sole structure, the posterior-most point being located within the posterior curved region.

4. The sole structure of claim 3, wherein the mid-foot curved portion extends from the MTP point to an aft point disposed within the mid-foot region of the sole structure between the MTP point and the posterior-most point.

5. The sole structure of claim 4, wherein the aft point and the anterior-most point are co-planar.

6. The sole structure of claim 5, wherein a planar extent of the posterior-most point is offset relative to the planar extent of the aft point and the anterior-most point.

7. The sole structure of claim 3, further comprising a blend portion disposed between and connecting the anterior curved region and the posterior curved region.

8. The sole structure of claim 7, wherein the blend portion includes a constant curvature.

9. The sole structure of claim 2, wherein the MTP point is located approximately thirty percent (30%) of the total length of the plate from the anterior-most point.

10. The sole structure of claim 2, wherein a center of the radius of curvature of the anterior curved region is located at the MTP point.

11. The sole structure of claim 2, wherein the exposed region of the plate includes the anterior curved region.

12. The sole structure of claim 1, wherein the peninsular region is disposed within the forefoot region of the sole structure.

13. The sole structure of claim 1, wherein the first aperture defined by the outsole includes an outsole apex point disposed within the mid-foot region of the sole structure, a lateral segment extending toward the forefoot region along the lateral side of the sole structure from the outsole apex point, and a medial segment extending toward the forefoot region along the medial side of the sole structure from the outsole apex point.

14. The sole structure of claim 13, wherein the outsole apex point is disposed closer to a heel region of the sole structure than the apex point of the second aperture defined by the cushioning member.

15. The sole structure of claim 1, wherein portions of the first aperture defined by the outsole that do not overlap with the second aperture defined by the cushioning member are operative to expose the cushioning member.

16. The sole structure of claim 1, further comprising a fluid-filled bladder disposed between the plate and the outsole.

17. The sole structure of claim 16, wherein the fluid-filled bladder is disposed within a cut-out region formed through the cushioning member.

18. The sole structure of claim 17, wherein a portion of the cut-out region unoccupied by the fluid-filled bladder defines the second aperture.

19. An article of footwear incorporating the sole structure of claim 1, the article of footwear comprising a strobel attached to an upper to define an interior void.

20. The article of footwear of claim 19, wherein the plate is disposed on the strobel within the interior void.

21. The article of footwear of claim 20, wherein the plate is visible through an ankle opening defined by the upper in a heel region of the sole structure, the ankle opening configured to provide access to the interior void.

22. The article of footwear of claim 19, further comprising a midsole received by the interior void of the upper and opposing the plate.

23. The article of footwear of claim 19, wherein the strobel defines a third aperture that overlaps with the overlapping portions of the first aperture and the second aperture to expose the plate.

* * * * *